US011140492B2

(12) United States Patent
Jang et al.

(10) Patent No.: US 11,140,492 B2
(45) Date of Patent: Oct. 5, 2021

(54) DISPLAY APPARATUS INCLUDING A SOUND GENERATING DEVICE

(71) Applicant: LG Display Co., Ltd., Seoul (KR)

(72) Inventors: YongGyoon Jang, Paju-si (KR); Chiwan Kim, Paju-si (KR); Taeheon Kim, Paju-si (KR); Sung-Eui Shin, Paju-si (KR); YongWoo Lee, Paju-si (KR); Kyungyeol Ryu, Paju-si (KR); YuSeon Kho, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/654,562

(22) Filed: Oct. 16, 2019

(65) Prior Publication Data

US 2020/0154214 A1 May 14, 2020

(30) Foreign Application Priority Data

Nov. 13, 2018 (KR) ..... 10-2018-0139230

(51) Int. Cl.
*H04R 17/00* (2006.01)
*H04R 1/02* (2006.01)

(52) U.S. Cl.
CPC ..... *H04R 17/005* (2013.01); *H04R 1/028* (2013.01); *H04R 2499/15* (2013.01)

(58) Field of Classification Search
CPC .. H04R 17/005; H04R 1/028; H04R 2499/15; H04R 7/04; H04R 7/045; H04R 7/06; H04R 7/10; G06F 1/1652
See application file for complete search history.

(56) References Cited

U.S. PATENT DOCUMENTS 4,517,490 A * 5/1985 Takahashi ..... H05B 33/145 313/502
9,621,997 B2 4/2017 Miyoshi et al.
2014/0210309 A1* 7/2014 Miyoshi ..... H04R 17/005 310/313 A
2015/0054382 A1 2/2015 Fujii et al.
(Continued)

FOREIGN PATENT DOCUMENTS

CN 103843365 A 6/2014
CN 104137286 A 11/2014
(Continued)

OTHER PUBLICATIONS

Deutz, "Flexible Piezoelectric Composites Bridging the Gap Between Material and Applications",Thesis, Delft University of Technology (2017).

(Continued)

*Primary Examiner* — Mark Fischer
(74) *Attorney, Agent, or Firm* — Morgan, Lewis & Bockius LLP

(57) ABSTRACT

A display apparatus includes a display panel including configured to display an image and a sound generating device on a rear surface of the display panel, the sound generating device being configured to vibrate the display panel to generate sound. The sound generating device includes a first structure and a second structure over or under the first structure, the second structure including a first part having a piezoelectric characteristic and a second part between adjacent first parts to have flexibility.

26 Claims, 19 Drawing Sheets

(56) References Cited

U.S. PATENT DOCUMENTS

| | | | | |
|---|---|---|---|---|
| 2015/0195657 | A1* | 7/2015 | Ishihara | B06B 1/0644 381/162 |
| 2016/0337760 | A1 | 11/2016 | Suenaga | |
| 2016/0353208 | A1 | 12/2016 | Matsuoka | |
| 2017/0118850 | A1* | 4/2017 | Kwon | F16M 11/22 |
| 2018/0070180 | A1* | 3/2018 | Melakari | G09G 3/3208 |
| 2018/0296843 | A1 | 10/2018 | Friis et al. | |
| 2018/0324519 | A1* | 11/2018 | Park | H04R 9/02 |

FOREIGN PATENT DOCUMENTS

| | | | |
|---|---|---|---|
| CN | 105072549 | A | 11/2015 |
| CN | 105874624 | A | 8/2016 |
| CN | 105900454 | A | 8/2016 |
| EP | 3 159 736 | A1 | 4/2017 |
| KR | 10-2015-0124986 | A | 11/2015 |
| KR | 10-1777491 | B1 | 9/2017 |
| WO | 2017/062399 | A1 | 4/2017 |

OTHER PUBLICATIONS

First Notification of Office Action dated Mar. 18, 2021, issued in corresponding Chinese Patent Application No. 201911036240.6.

* cited by examiner

200

400

DISPLAY APPARATUS INCLUDING A SOUND GENERATING DEVICE

This application claims the benefit of and priority to Korean Patent Application No. 10-2018-0139230, filed on Nov. 13, 2018, the entirety of which is hereby incorporated by reference.

BACKGROUND

Technical Field

The present disclosure relates to a display apparatus, and more particularly, to a display apparatus configured to vibrate a display panel to generate sound.

Discussion of the Related Art

Recently, as society advances toward an information-oriented society, the field of display apparatuses for visually displaying an electrical information signal has rapidly advanced. Consequently, various display apparatuses having excellent performance, such as thinness, light weight, and low power consumption, are being developed.

Examples of the display apparatuses may include liquid crystal display (LCD) apparatuses, field emission display (FED) apparatuses, organic light emitting display apparatuses, light emitting diode display apparatuses, quantum dot light emitting display apparatuses, and micro light emitting diode display apparatuses.

The LCD apparatuses include an array substrate including a thin film transistor (TFT), an upper substrate including a color filter and/or a black matrix, and a liquid crystal layer between the array substrate and the upper substrate. The LCD apparatuses are apparatuses in which an alignment state of the liquid crystal layer is adjusted with an electric field generated between two electrodes provided in a pixel area, and a transmittance of light is adjusted based on the alignment state, thereby displaying an image.

The organic light emitting display apparatuses, which are self-emitting devices, have low power consumption, a fast response time, high emission efficiency, excellent luminance, and a wide viewing angle.

Display apparatuses may include a display panel which displays an image and a sound device which outputs a sound along with an image. In the display apparatuses, a sound generated by the sound device travels toward a rear surface of the display panel or toward a region under the display panel, instead of toward a front surface of the display panel. Therefore, sound quality is degraded due to interference of a sound reflected from a wall or a floor. For this reason, it is difficult to provide a clear sound from the sound device without hindering an immersion experience of a user.

Moreover, when a speaker included in a set apparatus such as a television (TV), a computer monitor, a notebook computer, or a desktop personal computer (PC) is provided, the speaker occupies a certain space, and due to this, the design and space disposition of the set apparatus are limited.

A speaker applied to display apparatuses may be, for example, an actuator including a magnet and a coil. However, when the actuator is applied to the display apparatuses, a thickness thereof is thick. Piezoelectric elements that enable a thin thickness to be implemented are attracting much attention. Since the piezoelectric elements have a fragile characteristic, the piezoelectric elements are easily damaged by an external impact, and due to this, the reliability of sound reproduction is low.

SUMMARY

Accordingly, embodiments of the present disclosure are directed to a display apparatus that substantially obviates one or more of the issues due to limitations and disadvantages of the related art.

Therefore, the present inventors have recognized the above-described problems and have invented a display apparatus having a new structure, which includes a sound generating device having a thin thickness for realizing a thin thickness of the display apparatus and decreases an influence of an external impact.

An aspect of the present disclosure is to provide a display apparatus including a sound generating device for decreasing an influence of an external impact and enhancing a sound characteristic.

Additional features and aspects will be set forth in the description that follows, and in part will be apparent from the description, or may be learned by practice of the inventive concepts provided herein. Other features and aspects of the invention concepts may be realized and attained by the structure particularly pointed out in the written description, or derivable therefrom, and the claims hereof as well as the appended drawings.

To achieve these and other aspects of the inventive concepts as embodied and broadly described herein, a display apparatus comprising a display panel configured to display an image and a sound generating device on a rear surface of the display panel, the sound generating device being configured to vibrate the display panel to generate sound, wherein the sound generating device includes a first structure and a second structure on or under the first structure, the second structure including a first part having a piezoelectric characteristic and a second part between adjacent first parts to have flexibility.

In another aspect a display apparatus comprising a display panel configured to display an image and a sound generating device on a rear surface of the display panel, the sound generating device being configured to vibrate the display panel to generate sound, wherein the sound generating device includes a first structure including a polymer piezoelectric material and a second structure over or under the first structure to have a piezoelectric characteristic.

In another aspect, a sound generating device comprising a first structure including a polymer piezoelectric material, and a second structure over or under the first structure, wherein the second structure including a first part having a piezoelectric characteristic and a second part between adjacent first parts to have flexibility.

A display apparatus according to an embodiment of the present disclosure may include the sound generating device including the first structure and the second structure, and thus, may secure the impact resistance and flexibility of the sound generating device. Accordingly, a display apparatus having an excellent vibration characteristic and an excellent sound characteristic may be provided.

Moreover, the display apparatus according to an embodiment of the present disclosure may include the sound generating device including the first structure and the second structure, and thus, may decrease an influence of an external impact. Accordingly, a sound generating device with enhanced flexibility and sound pressure level may be provided, and thus, may be applied to a flexible display apparatus.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with embodiments of the disclosure. It is to be understood that both the foregoing general description and the following detailed description of the present disclosure are examples and explanatory and are intended to provide further explanation of the disclosure as claimed.

BRIEF DESCRIPTION OF THE DRAWINGS

The accompanying drawings, that may be included to provide a further understanding of the disclosure and are incorporated in and constitute a part of this application, illustrate embodiments of the disclosure and together with the description serve to explain various principles of the disclosure.

Figure 1:
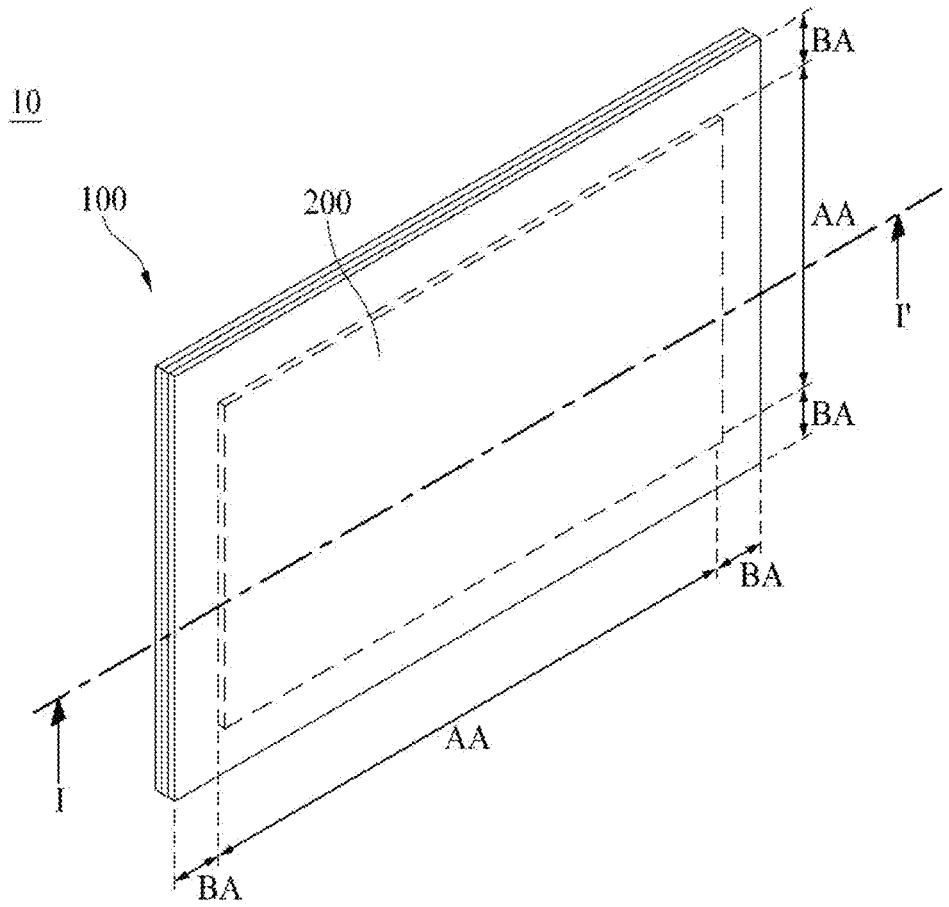
FIG. 1 illustrates a display apparatus including a sound generating device according to an embodiment of the present disclosure.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to the exemplary embodiments of the present disclosure, examples of which may be illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted. In a case where "comprise," "have," and "include" described in the present specification are used, another part may be added unless "only" is used. The terms of a singular form may include plural forms unless referred to the contrary.

In construing an element, the element is construed as including an error range although there is no explicit description.

In describing a position relationship, for example, when a position relation between two parts is described as "on," "over," "under," and "next," one or more other parts may be disposed between the two parts unless "just" or "direct(ly)" is used.

In describing a time relationship, for example, when the temporal order is described as "after," "subsequent," "next," and "before," a case which is not continuous may be included unless "just" or "direct(ly)" is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing the elements of the present disclosure, terms such as "first," "second," "A," "B," "(a)," "(b)," etc., may be used. Such terms are used for merely discriminating the corresponding elements from other elements and the corresponding elements are not limited in their essence, sequence, or precedence by the terms. It will be understood that when an element or layer is referred to as being "on" or "connected to" another element or layer, it can be directly on or directly connected to the other element or layer, or intervening elements or layers may be present. Also, it should be understood that when one element is disposed on or under another element, this may denote a case where the elements are disposed to directly contact each other, but may denote that the elements are disposed without directly contacting each other.

The term "at least one" should be understood as including any and all combinations of one or more of the associated listed elements. For example, the meaning of "at least one of a first element, a second element, and a third element" denotes the combination of all elements proposed from two or more of the first element, the second element, and the third element as well as the first element, the second element, or the third element.

Features of various embodiments of the present disclosure may be partially or overall coupled to or combined to each other, and may be variously inter-operated to each other and driven technically as those skilled in the art can sufficiently understand. The embodiments of the present disclosure may be carried out independently from each other, or may be carried out together in co-dependent relationship.

In the present disclosure, examples of a display apparatus may include a narrow-sense display apparatus such as an organic light emitting display (OLED) module or a liquid crystal module (LCM) including a display panel and a driver for driving the display panel. Also, examples of the display apparatus may include a set device (or a set apparatus) or a set electronic device (or a set electronic apparatus) such as a notebook computer, a television (TV), a computer monitor, an equipment apparatus including an automotive apparatus or another type apparatuses for vehicles, or a mobile electronic apparatus such as a smartphone or an electronic pad, which is a complete product (or a final product) including an LCM or an OLED module.

Therefore, in the present disclosure, examples of the display apparatus may include a narrow-sense display apparatus itself, such as an LCM or an OLED module, and a set apparatus which is a final consumer apparatus or an application product including the LCM or the OLED module.

In some embodiments, an LCM or an OLED module including a display panel and a driver may be referred to as a narrow-sense display apparatus, and an electronic device which is a final product including an LCM or an OLED module may be referred to as a set device. For example, the narrow-sense display apparatus may include a display panel, such as an LCD or an OLED, and a source printed circuit board (PCB) that is a controller for driving the display panel. The set device may further include a set PCB which is a set controller electrically connected to the source PCB to overall control the set device.

A display panel applied to the present embodiment may use any type of display panel, such as a liquid crystal display panel, an organic light emitting diode (OLED) display panel, and an electroluminescent display panel, but is not limited to a specific display panel that is vibrated by a sound generation device according to the present embodiment to output a sound. Also, a shape or a size of a display panel applied to a display apparatus according to an embodiment of the present disclosure is not limited.

For example, if the display panel is the liquid crystal display panel, the display panel may include a plurality of gate lines, a plurality of data lines, and a plurality of pixels respectively provided in a plurality of pixel areas defined by intersections of the gate lines and the data lines. Also, the display panel may include an array substrate including a thin film transistor (TFT), which is a switching element for adjusting a light transmittance of each of the plurality of pixels, an upper substrate including a color filter and/or a black matrix, and a liquid crystal layer between the array substrate and the upper substrate.

Moreover, if the display panel is the organic light emitting display panel, the display panel may include a plurality of gate lines, a plurality of data lines, and a plurality of pixels respectively provided in a plurality of pixel areas defined by intersections of the gate lines and the data lines. Also, the display panel may include an array substrate including a TFT which is an element for selectively applying a voltage to each of the pixels, an organic light emitting device layer on the array substrate, and an encapsulation substrate disposed on the array substrate to cover the organic light emitting device layer. The encapsulation substrate may protect the TFT and the organic light emitting device layer from an external impact and may prevent water or oxygen from penetrating into the organic light emitting device layer. Also, a layer provided on the array substrate may include an inorganic light emitting layer (for example, a nano-sized material layer, a quantum dot, or the like). As another example, the layer provided on the array substrate may include a micro light emitting diode.

The display panel may further include a backing such as a metal plate attached to the display panel. However, embodiments are not limited to the metal plate, and the display panel may include another structure.

In the present disclosure, the display panel may be applied to vehicles as a user interface module such as a central control panel for automobiles. For example, the display panel may be provided between occupants sitting on two front seats in order for a vibration of the display panel to be transferred to the inside of a vehicle. Therefore, an audio experience in a vehicle is improved in comparison with a case where speakers are disposed on interior sides of the vehicle.

Hereinafter, embodiments of the present disclosure will be described in detail with reference to the accompanying drawings.

Figure 2:
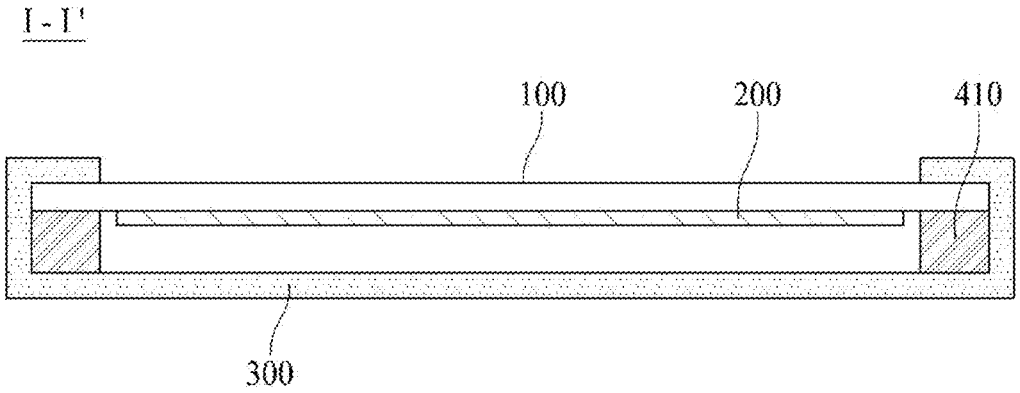
FIG. 2 is a cross-sectional view taken along line I-I' of FIG. 1.

FIG. 1 illustrates a display apparatus including a sound generating device according to an embodiment of the present disclosure. FIG. 2 is a cross-sectional view taken along line I-I' of FIG. 1.

With reference to FIG. 1, the display apparatus 10 may include a display panel 100, which displays an image, and a sound generating device 200 which is disposed on a rear surface of the display panel 100 and vibrates the display panel 100 to generate sound. For example, the sound generating device 200 may directly vibrate the display panel 100 to output sound toward a forward region in front of the display panel 100.

The display panel 100 may include a display area AA which displays an image and a non-display area which surrounds the display area AA. The non-display area may include a bending area BA. The bending area BA may be bent to form a curved surface.

The display panel 100 may display an image and may be implemented as any type of display panel, such as a liquid crystal display panel, an organic light emitting diode (OLED) display panel, an electroluminescent display panel, etc. The display panel 100 may vibrate based on a vibration of the sound generating device 200 to output a sound.

According to an embodiment, the display panel 100 may display an image in a type such as a top emission type, a bottom emission type, or a dual emission type, based on a structure of a pixel array layer including an anode electrode, a cathode electrode, and an organic compound layer. In the top emission type, visible light emitted from the pixel array layer may be irradiated onto a region in front of a base substrate to allow an image to be displayed. In the bottom emission type, the visible light emitted from the pixel array layer may be irradiated onto a rearward region behind the base substrate to allow an image to be displayed.

Moreover, the sound generating device 200 may generate a sound by using the display panel 100 as a vibration plate. The sound generating device 200 may be referred to as an "actuator," an "exciter," or a "transducer," but embodiment are not limited thereto. For example, the sound generating device 200 may be a sound device for outputting a sound according to an electrical signal.

FIG. 2 is a cross-sectional view taken along line I-I' of FIG. 1.

With reference to FIG. 2, the display apparatus 10 may include the sound generating device 200 and a supporting member 300.

The supporting member 300 may support one or more of a rear surface and a side surface of the display panel 100. Also, the sound generating device 200 may be fixed to the supporting member 300.

The supporting member 300 may be, for example, a cover bottom. For example, the supporting member 300 may include a middle cabinet, which may be coupled or connected to a cover bottom to surround the side surface of the display panel 100 and accommodate one edge or periphery of the display panel 100 to support the display panel 100. For example, the middle cabinet may include a sideways-T (¬)-shaped cross-sectional surface (or a T-shape having a 90-degree angle). The supporting member 300 may include the cover bottom, or may include the cover bottom and the middle cabinet, but embodiment are not limited thereto. For example, the supporting member 300 may include a structure that supports the rear surface or the side surface of the display panel 100.

Moreover, the supporting member 300 may be a plate member that may be provided on the rear surface of the display panel 100 or the whole display panel 100. For example, the supporting member 300 may cover the whole rear surface of the display panel 100 so as to be spaced apart from the rear surface. Also, the supporting member 300 may have a plate shape formed of a glass material, a metal material, or a plastic material. Here, an edge or a sharp corner of the supporting member 300 may have a tetragonal (e.g., quadrilateral) shape or a curved shape, e.g., through a chamfering process or a corner rounding process. According to an embodiment of the present disclosure, the supporting member 300 including the glass material may include sapphire glass. For example, the supporting member 300 including the metal material may include one or more of aluminum (Al), an Al alloy, a magnesium (Mg) alloy, and an iron (Fe)-nickel (Ni) alloy. As another example, the supporting member 300 may have a stacked structure including a glass plate and a metal plate, in which the metal plate may have a thickness relatively thinner than the glass plate and the glass plate may face the rear surface of the display panel 100. For example, a rear surface of the display apparatus 10 may be used as a mirror surface due to the metal plate.

Moreover, in the present disclosure, the supporting member 300 may be referred to as a "cover bottom," a "plate bottom," a "back cover," a "base frame," a "metal frame," a "metal chassis," a "chassis base," or an "m-chassis." Therefore, the supporting member 300 may be a supporter for supporting the display panel 100 and may be implemented as any type of frame or plate structure on the rear surface of the display apparatus.

An adhesive member 410 may be disposed in an edge or periphery of the display panel 100 and the supporting member 300. For example, the adhesive member 410 may be between the rear surface of the display panel 100 and an upper surface of the supporting member 300. The adhesive member 410 may attach the display panel 100 to the supporting member 300. Also, the adhesive member 410 may include a double-sided tape, a single-sided tape, an adhesive, a bond, and/or the like, but embodiment are not limited thereto.

When a sound generating device is disposed on a rear surface of a display panel, there is a problem where a thickness of a display apparatus is thickened as a thickness of the sound generating device is thickened. To solve the problem, a piezoelectric device having a thin thickness may be applied, but since the piezoelectric device is vulnerable to an external impact, the piezoelectric device is fragile, and due to this, has a problem where it is difficult to output a desired sound. Therefore, the present inventors have implemented a sound generating device that vibrates a display panel to output a desired sound and decreases an impact applied thereto from the outside. This will be described below with reference to FIGS. 3 to 14.

Figure 3A:
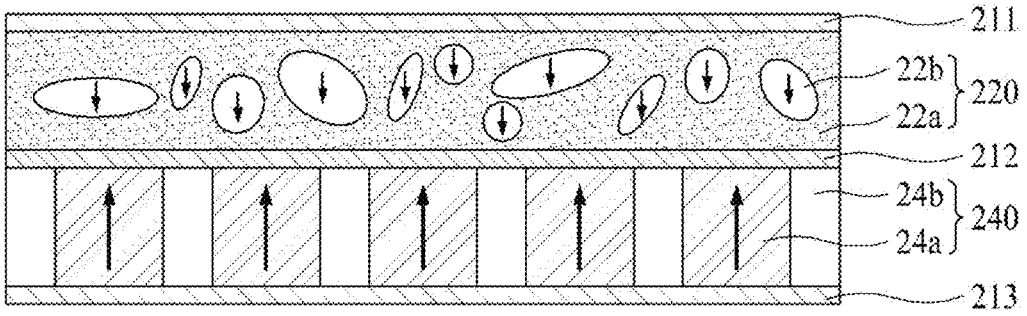
FIGS. 3A and 3B illustrate a sound generating device according to an embodiment of the present disclosure.
Figure 3B:
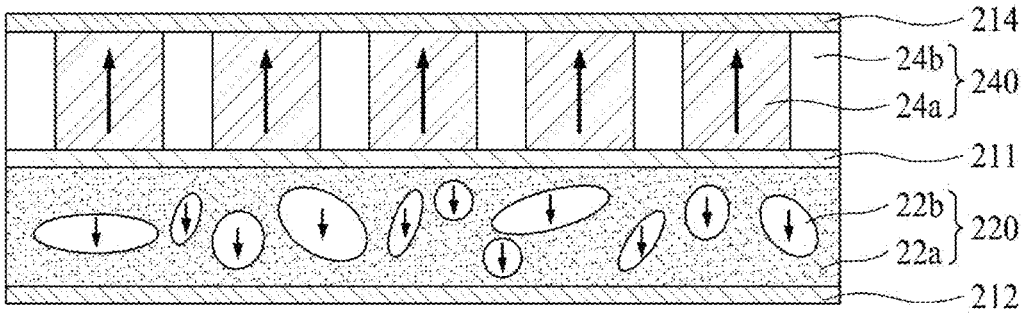

FIGS. 3A and 3B illustrate a sound generating device according to an embodiment of the present disclosure.

With reference to FIG. 3A, the sound generating device 200 may include a first structure 220 and a second structure 240. When a speaker having a single layer of the first structure 220 is applied to a display apparatus, there may be vertical polarization not sufficient to vibrate the display panel 100, and due to this, there may be a problem where it is difficult to secure a sound pressure characteristic suitable for a speaker. Also, when a speaker having a single layer of the second structure 240 is applied to a display apparatus, since it is possible to secure a sound characteristic suitable for a speaker by generating a sufficient vibration in a direction vertical to the second structure 240 but a portion having the piezoelectric properties of the second structure 240 is aligned in a horizontal direction with respect to a widthwise direction of the display panel 100, it is difficult to have a flexible characteristic other than a vertical direction with respect to an alignment direction, and it is difficult to secure an appropriate flexible characteristic in the vertical direction. When the first structure 220 is formed of several layers or the second structure 240 is formed of several layers so as to secure a sufficient vibration capable of having a sound pressure characteristic and improve the flexibility of a speaker, a thickness of the speaker is thickened, and due to this, the display panel 100 is thickened.

Moreover, to apply a sound generating device to a display panel, an external impact should not be applied to the sound generating device. Therefore, the present inventors have performed an impact experiment after a sound generating device is applied to a display apparatus. This will be described below with reference to FIGS. 4A to 4C.

Figure 4A:
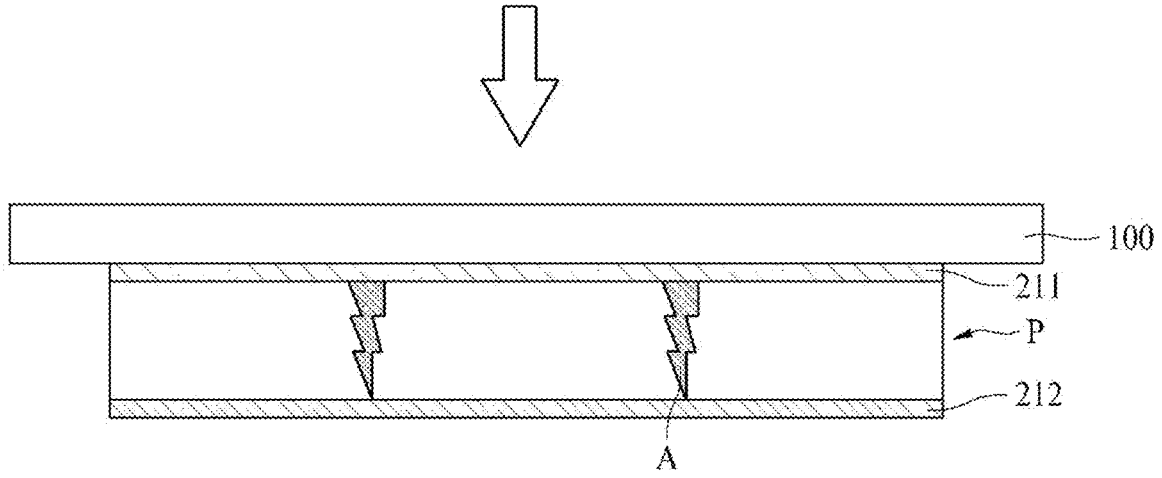
FIGS. 4A to 4C illustrate for describing an influence of an external impact on a sound generating device.
Figure 4B:
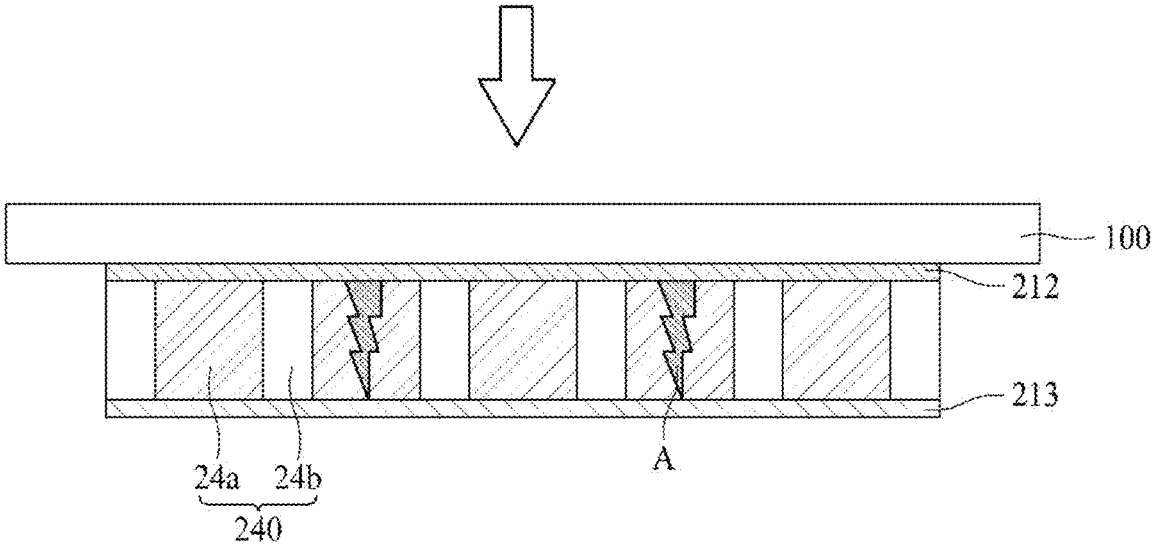
Figure 4C:
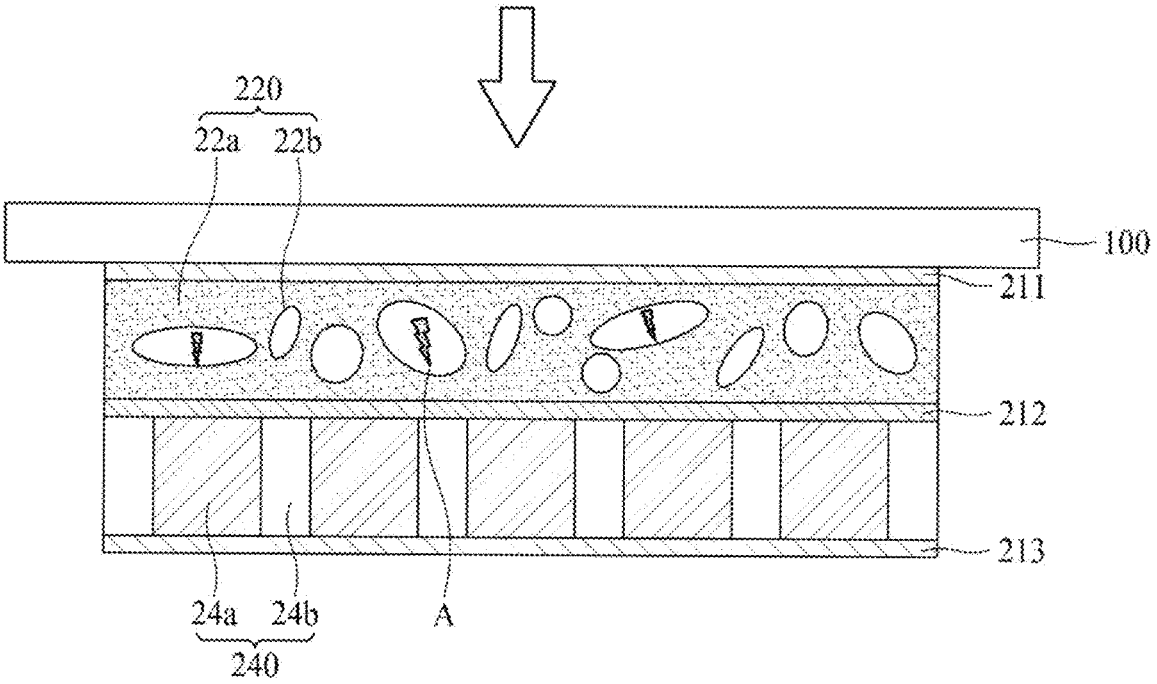

FIGS. 4A to 4C illustrate for describing an influence of an external impact on a sound generating device.

An external impact test performed on a display apparatus may use, for example, a ball drop test. The ball drop test may be a test where a sound generating module impacted and a display panel including the same are fixed to a drop position, and by allowing an iron bead having a weight of 100 g or 1,000 g to freely fall at a distance of 1 m in a vertical direction, the display performance of an impacted display panel before the ball drop test is compared with the display performance of an impacted display panel after the ball drop test. When desires to check a quantitative control issue and a secondary collision issue in association with free fall with respect to a finished display apparatus to which a display panel and a sound generating module are applied, a free falling impact test with reliability added thereto may be used. The free falling impact test may be a test where, in a state where a finished display apparatus is applied, a falling target is transported by a certain height, for example 1 meter or more, and is freely fallen on a falling floor surface, and by using various sensors, a degree of damage of a freely fallen target is determined. However, embodiment are not limited thereto, and another method may be used as an impact test performed on a display panel and a sound generating module.

FIG. 4A illustrates a comparative example where a piezoelectric device is applied to a display apparatus. FIG. 4B illustrates an example where a second structure is applied. FIG. 4C illustrates an example where FIG. 3A is applied.

With reference to FIG. 4A, a plurality of electrodes 211 and 212 may be respectively disposed over and under piezoelectric ceramic which is a piezoelectric device P. The electrode 211 may be a positive (+) electrode, and the electrode 212 may be a negative (−) electrode. A young's modulus of the piezoelectric device P may be high, and due to this, when an external impact (illustrated by an arrow) is applied to the piezoelectric device P, the piezoelectric device P may be broken. A portion broken by an impact applied thereto is illustrated by "A". For example, the young's modulus of the piezoelectric device P may be 50 GPa or more. When an external impact is applied to a display apparatus, a screen of the display apparatus may be displayed, but since a piezoelectric device is broken, a sound may not be reproduced.

With reference to FIG. 4B, a plurality of electrodes 212 and 213 may be respectively disposed over and under a second structure 240. The electrode 213 may be a positive (+) electrode, and the electrode 212 may be a negative (−) electrode. For example, a young's modulus of the second structure 240 may be 50 GPa or less. The young's modulus of the second structure 240 may be less than a young's modulus of a piezoelectric device, the second structure 240 may have a characteristic robust to an impact. For example, an impact may be absorbed by an organic material part 24*b* included in the second structure 240, but an inorganic material part may be partially broken (illustrated by "A"). Due to this, the performance or characteristic of a sound generating device may be reduced.

With reference to FIG. 4C, a sound generating device may include a first structure 220 and a second structure 240. The sound generating device may include a first electrode 211 disposed over the first structure 220, a second electrode 212 disposed under the first structure 220, and a third electrode 213 disposed under the second structure 240. The first electrode 211 and the third electrode 213 may be a positive (+) electrode, and the second electrode 212 may be a negative (−) electrode. A young's modulus of the first structure 220 may be low, and thus, the first structure 220 may act as a protection layer for absorbing or offsetting an external impact. For example, the young's modulus of the first structure 220 may be 1 GPa or less. Therefore, the external impact may not be transferred to the second structure 240, and thus, an impact resistance of the sound generating device may be enhanced. Even when partial damage (illustrated by "A") caused by the external impact occurs in the first structure 220, the second structure 240 for performing a main function of the sound generating device may reproduce a sound.

Therefore, the present inventors have performed various experiments on a sound generating device having flexibility and an impact resistance. Through the various experiments, the present inventors have invented a display apparatus including a sound generating device that outputs a sound by using a display panel as a vibration plate and secures an impact resistance and flexibility.

With reference to FIG. 3A, a sound generating device 200 according to an embodiment of the present disclosure may include a first structure 220 and a second structure 240. For example, the first structure 220 may be disposed over the second structure 240. However, embodiments are not limited thereto, and the second structure 240 may be disposed over the first structure 220. The first structure 220 may be formed of a polymer piezoelectric material. For example, the first structure 220 may include a piezoelectric material 22*b* included in the polymer matrix 22*a*. The piezoelectric material 22*b* may be dispersed in the polymer matrix 22*a*. The polymer matrix 22*a* may include, for example, at least one of polyvinylidene fluoride (PVDF), β-Polyvinylidene fluoride (β-PVDF), polyvinylidene-trifluoroethylene (PVDF-TrFE), rubber, polyurethane, polyethylene, PTFE, polypropylene, nylon, polycarbonate, polyimide, epoxy resin, and acrylic resin, but embodiments are not limited thereto. The piezoelectric material 22*b* may be piezoelectric ceramic having a perovskite crystalline structure or a wurtzite crystalline structure, but embodiments are not limited thereto. The piezoelectric material 22*b* may include, for example, at least one of perovskite ($CaTiO_3$), barium titanate ($BaTiO_3$), lead zirconate titanate, (PZT) ($PbZrTiO_3$), quartz ($SiO_2$), strontium titanate ($SrTiO_3$), aluminum nitride (AlN), silver iodide (AgI), zinc oxide (ZnO), cadmium sulfide (CdS), cadmium selenide (CdSe), silicon carbide (α-SiC), gallium (III) nitride (GaN), and boron nitride (BN), but embodiments are not limited thereto.

The flexibility of the first structure 220 may be affected by the physical properties of the polymer matrix 22*a*, a size of the first structure 220, etc. For example, when a thickness of the first structure 220 is 300 μm or less, the first structure 220 may have flexibility, and the thickness is not limited thereto. The flexibility of the first structure 220 may be enhanced by adjusting a volume ratio of the polymer matrix 22*a* and the piezoelectric material 22*b* and may be affected by a size of the first structure 220, a thickness of the first structure 220, a product with the first structure 220 applied thereto, and/or the like. For example, when the piezoelectric material 22*b* is formed of PZT and a volume ratio of PZT is 60%, the young's modulus of the first structure 220 may be 5.1 GPa. Accordingly, the polymer matrix 22*a* may have a volume ratio of 40%, and the piezoelectric material 22*b* may have a volume ratio of 60%. For example, the flexibility of the first structure 220 may be enhanced.

The second structure 240 may include a first part 24*a* and a second part 24*b* between adjacent first parts 24*a*. The first part 24*a* may include an inorganic material part, and the second part 24*b* may include an organic material part.

The first part 24*a* of the second structure 240 may have piezoelectric properties. Therefore, the inorganic material part may be formed of a ceramic-based electrically active material for realizing a high vibration. For example, the inorganic material part may be formed of a ceramic-based material for realizing a high vibration. As another example, the inorganic material part may be formed of piezoelectric ceramic having a perovskite crystalline structure. The perovskite crystalline structure may be a plate-shaped structure that has a piezoelectric effect, an inverse piezoelectric effect, and alignment properties. The perovskite crystalline structure may be represented by an $ABO_3$ chemical formula, wherein A includes a divalent metal element and B includes a tetravalent metal element. As another example, the inorganic material part may include one or more of lead (Pb), zirconium (Zr), titanium (Ti), zinc (Zn), nickel (Ni), and niobium (Nb), but embodiment are not limited thereto. As another example, the inorganic material part may include a PZT-based material including lead (Pb), zirconium (Zr), and titanium (Ti) and a PZNN-based material including lead (Pb), zinc (Zn), nickel (Ni), and niobium (Nb), but embodiment are not limited thereto. Also, the inorganic material part may include at least one of perovskite ($CaTiO_3$), barium titanate ($BaTiO_3$), and strontium titanate ($SrTiO_3$) including no Pb, but embodiments are not limited thereto. As another example, the inorganic material part may include piezoelectric ceramic having a wurtzite crystalline structure. For example, the inorganic material part may include at least one of aluminum nitride (AlN), silver iodide (AgI), zinc oxide (ZnO), cadmium sulfide (CdS), cadmium selenide (CdSe), silicon carbide (α-SiC), gallium(III) nitride (GaN), and boron nitride (BN), but embodiments are not limited thereto.

The second part 24*b* may be configured to fill a space between adjacent first parts 24*a*. For example, the second part 24*b* may be formed of an organic material, and may be disposed to fill a space between adjacent inorganic material parts which are first parts 24*a*. Alternatively, a plurality of first parts 24*a* and a plurality of second parts 24*b* may be alternately disposed. For example, an inorganic material part which is the first part 24*a* and an organic material part which is the second part 24*b* may be alternately disposed.

The second part 24*b* of the second structure 240 may have flexibility. The organic material part may include at least one of an organic piezoelectric material and an organic non-piezoelectric material. When the organic material part includes the organic piezoelectric material, the organic material part may be formed of a polymer having flexibility instead of ceramic, and thus, may absorb an impact applied to the inorganic material part and may release a stress concentrating on the inorganic material part, thereby enhancing the durability and impact resistance of the second structure 240 and providing a certain level of piezoelectric characteristic. The organic piezoelectric material may be a material having an electrically active characteristic. For example, the organic piezoelectric material may include at least one of PVDF, β-PVDF, and PVDF-TrFE, but embodiment are not limited thereto. The organic non-piezoelectric material may include at least one of an acrylic polymer, a silicon-based polymer, and an epoxy-based polymer, but embodiment are not limited thereto.

A ceramic plate including an inorganic material part which is the first part 24*a* may be formed and may be diced, and then, an organic material part which is the second part 24*b* may be filled into diced portions, thereby forming the second structure 240. A method of dicing the inorganic material part may use at least one of scribing, blade dicing, laser cutting, stealth dicing, and thermal laser separation (TLS), but embodiment are not limited thereto. As another example, the second structure 240 may be formed by filling the organic material part into the inorganic material part that is formed in a fiber form and aligned, but embodiments are not limited thereto.

The sound generating device may include a first electrode 211 disposed over the first structure 220, a second electrode 212 disposed under the first structure 220, and a third electrode 213 disposed under the second structure 240. The first electrode 211, the second electrode 212, and the third electrode 213 may apply a voltage to the first structure 220 and the second structure 240. For example, the first electrode 211 and the third electrode 213 may be a positive (+) electrode, and the second electrode 212 may be a negative (−) electrode. As another example, the first electrode 211 and the third electrode 213 may be a negative (−) electrode, and the second electrode 212 may be a positive (+) electrode. For example, the first electrode 211, the second electrode 212, and the third electrode 213 may include one or more of carbon (C), palladium (Pd), iron (Fe), tin (Sn), aluminum (Al), nickel (Ni), platinum (Pt), gold (Au), silver (Ag), copper (Cu), titanium (Ti), and molybdenum (Mo), or an alloy thereof, but embodiments are not limited thereto. For example, the first electrode 211, the second electrode 212, and the third electrode 213 may include indium tin oxide (ITO) or a molybdenum-titanium alloy (a Mo—Ti alloy), but embodiments are not limited thereto.

When an alternating current (AC) voltage is applied to the first electrode 211, the second electrode 212, and the third electrode 213 of the sound generating device 200, the first structure 220 and the second structure 240 may alternately and repeatedly expand and contract, thereby generating a vibration based on a bending phenomenon where a bending direction is alternately changed. The display panel 100 may vibrate based on the generated vibration to generate a sound. The display panel 100 may vibrate with kinetic energy based on polarization which is performed in a direction vertical to the display panel 100. Therefore, polarization performed in a vector direction except the direction vertical to the display panel 100 may be lost. A whole vibration of the sound generating device 200 may be affected by summated energy in the vector direction vertical to the display panel 100, and thus, a polarization direction (illustrated by an arrow) of the first structure 220 and a polarization direction (illustrated by an arrow) of the second structure 240 may be a direction vertical to the display panel 100. The display panel 100 may vibrate based on the expansion and contraction of the first structure 220 and the second structure 240, and thus, when a polarization direction of the first structure 220 is opposite to that of the second structure 240, a sound pressure level of the sound generating device 200 may be enhanced. The second structure 240 may form a polarization direction vertical to the display panel 100, and thus, the polarization direction of the first structure 220 may be aligned in a direction vertical to the display panel 100, thereby increasing a vibration of the sound generating device 200. Accordingly, a sound pressure level of the sound generating device 200 may be further enhanced.

With reference to FIG. 3B, a second structure 240 of a sound generating device 400 according to an embodiment of the present disclosure may be disposed over a first structure 220. The sound generating device 400 may include a first electrode 211 disposed over the first structure 220, a second electrode 212 disposed under the first structure 220, and a fourth electrode 214 disposed over the second structure 240. The first electrode 211, the second electrode 212, and the fourth electrode 214 may apply a voltage to the first structure 220 and the second structure 240. For example, the first electrode 211 may be a positive (+) electrode, and the second electrode 212 and the fourth electrode 214 may be a negative (−) electrode. For example, the first electrode 211, the second electrode 212, and the fourth electrode 214 may include one or more of carbon (C), palladium (Pd), iron (Fe), tin (Sn), aluminum (Al), nickel (Ni), platinum (Pt), gold (Au), silver (Ag), copper (Cu), titanium (Ti), and molybdenum (Mo), or an alloy thereof, but embodiments are not limited thereto. For example, the first electrode 211, the second electrode 212, and the fourth electrode 214 may include ITO or a Mo—Ti alloy, but embodiments are not limited thereto.

When an AC voltage is applied to the first electrode 211, the second electrode 212, and the fourth electrode 214 of the sound generating device 400, the first structure 220 and the second structure 240 may alternately and repeatedly expand and contract, thereby generating a vibration based on a bending phenomenon where a bending direction is alternately changed. The display panel 100 may vibrate based on the generated vibration to generate sound. The display panel 100 may vibrate with kinetic energy based on polarization that is performed in a direction vertical to the display panel 100. Therefore, polarization performed in a vector direction except the direction vertical to the display panel 100 may be lost. A whole vibration of the sound generating device 400 may be affected by summated energy in the vector direction vertical to the display panel 100, and thus, a polarization direction (illustrated by an arrow) of the first structure 220 and a polarization direction (illustrated by an arrow) of the second structure 240 may be a direction vertical to the display panel 100. The display panel 100 may vibrate based on the expansion and contraction of the first structure 220 and the second structure 240, and thus, when a polarization direction of the first structure 220 is opposite to that of the second structure 240, a sound pressure level of the sound generating device 400 may be enhanced. The sound generating device 400 may be configured by the first structure 220 and the second structure 240, the second structure 240 may form a polarization direction vertical to the display panel 100, and the polarization direction of the first structure 220 may be aligned in a direction vertical to the display panel 100, thereby increasing a vibration of the sound generating device 400. Accordingly, a sound pressure level of the sound generating device 400 may be more enhanced. Therefore, in the sound generating device 400 according to an embodiment of the present disclosure, since a polarization direction vertical to the display panel 100 is formed by the second structure 240, a sound characteristic may be secured, and a flexible characteristic may be secured by the first structure 220, thereby providing a display apparatus with enhanced sound characteristic and flexibility.

A size of the sound generating device 200,400 may be the same as that of the display panel 100. Since the sound generating device 200, 400 is configured to secure a wide area or region corresponding to a size equal to that of the display panel 100, a sound characteristic of a low-pitched sound band may be improved compared to a film-type piezoelectric device, and a driving voltage may be reduced. For example, a size of the sound generating device 200, 400 may be 0.9 to 1.1 times a size of a display area AA of the display panel 100, but embodiments are not limited thereto. Since a size of the sound generating device 200, 400 is the same as or approximately equal to that of the display area AA of the display panel 100, the sound generating device 200, 400 may cover a most region of the display panel 100, and a vibration generated by the sound generating device 200, 400 may vibrate a whole portion of the display panel 10, thereby enhancing a sound localization. Also, in a large-sized display apparatus, a whole portion of the large-sized display apparatus may vibrate, and thus, of a sound localization may be further enhanced, thereby realizing a stereo sound effect.

Therefore, since the sound generating device includes the first structure having an impact resistance and flexibility and the second structure having a piezoelectric characteristic, the impact resistance and flexibility of the sound generating device may be secured. Accordingly, a display apparatus having an excellent vibration characteristic and an excellent sound characteristic may be provided.

Figure 5:
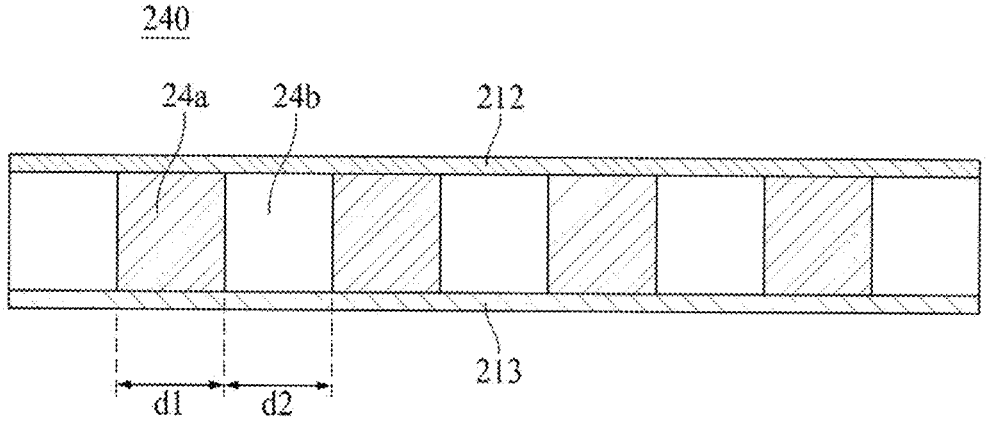
FIG. 5 illustrates an example of a second structure of a sound generating device according to an embodiment of the present disclosure.

FIG. 5 illustrates an example of a second structure of a sound generating device according to an embodiment of the present disclosure.

With reference to FIG. 5, a second structure 240 of a sound generating device described above with reference to FIGS. 3A and 3B may include a first part 24*a* and a second part 24*b*. The first part 24*a* and the second part 24*b* may be disposed in parallel on the same plane. The second part 24*b* may be configured to fill a space between adjacent first parts 24*a*. For example, the second part 24*b* may be formed of an organic material and may be disposed to fill a space between adjacent inorganic material parts which are first parts 24*a*. Alternatively, a plurality of first parts 24*a* and a plurality of second parts 24*b* may be alternately disposed. For example, an inorganic material part which is the first part 24*a* and an organic material part which is the second part 24*b* may be alternately disposed.

The second structure 240 of the sound generating device may include a plurality of diagonal patterns. The plurality of diagonal patterns may be a plurality of line patterns having a certain width d1, and one of the plurality of line patterns may have distance of a certain width d2 with respect to another pattern which is adjacent thereto and spaced apart therefrom. An organic material part configuring the second part 24*b* may be between the plurality of line patterns to have the width d2 of an inorganic material part configuring the first part 24*a*. The plurality of line patterns may be at least one of various patterns such as a line pattern, a tetragonal pattern, a pentagonal pattern, and a honeycomb pattern, but embodiments are not limited thereto. Also, a plurality of circular patterns may have a circular shape, an oval shape, or a donut shape. The inorganic material part configuring the first part 24*a* may include a plurality of diagonal patterns or a plurality of circular patterns spaced apart from one another, and the organic material part configuring the second part 24*b* may be disposed to fill a space between adjacent inorganic material parts configuring the first part 24*a*.

Figure 6A:
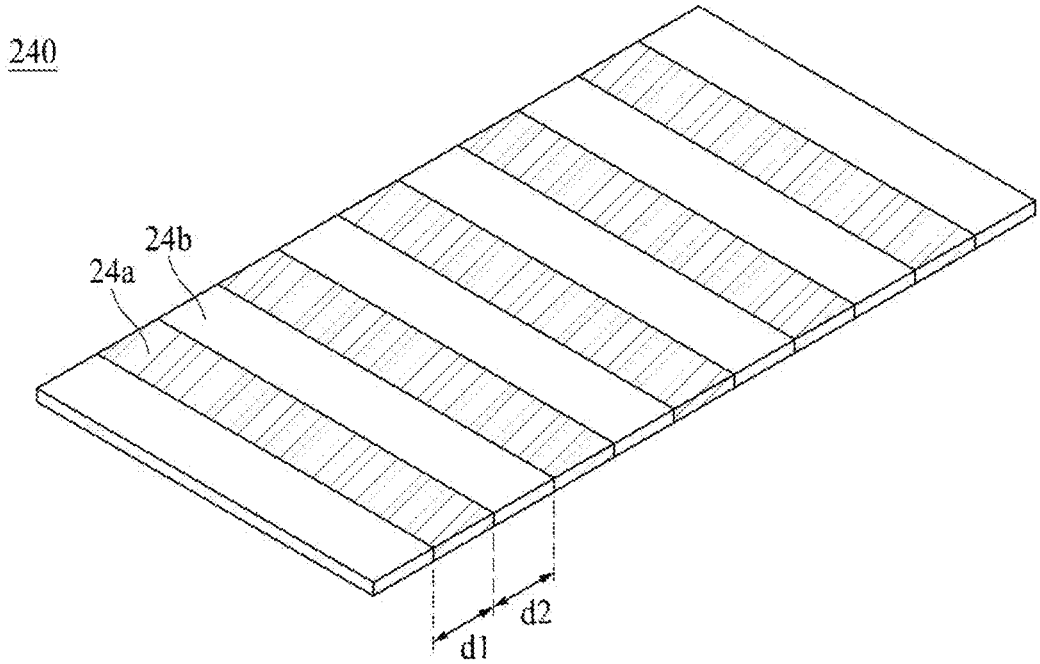
FIGS. 6A to 6C illustrate another example of a second structure of a sound generating device according to an embodiment of the present disclosure.
Figure 6B:
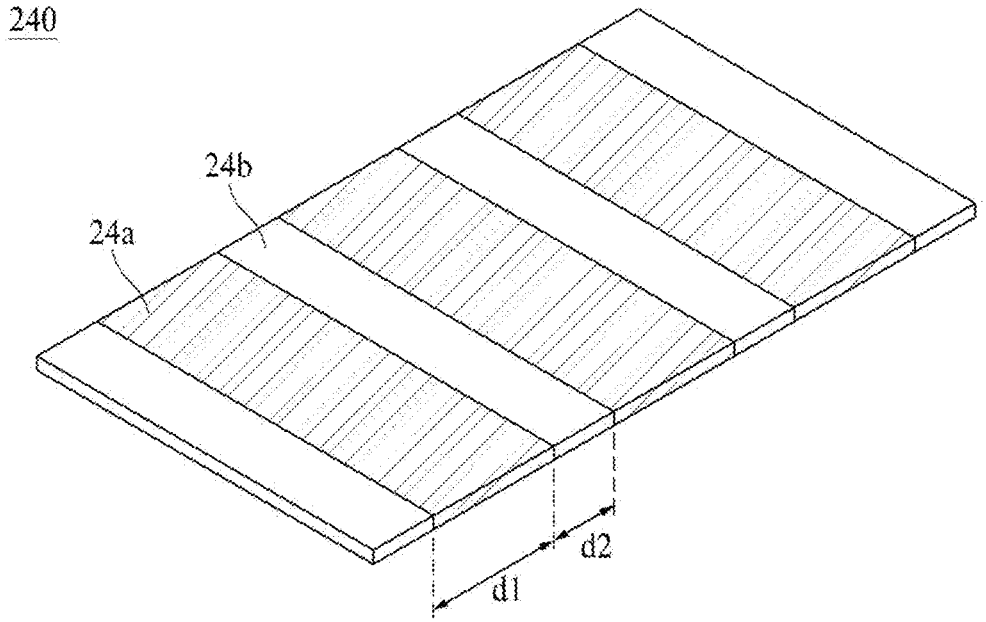
Figure 6C:
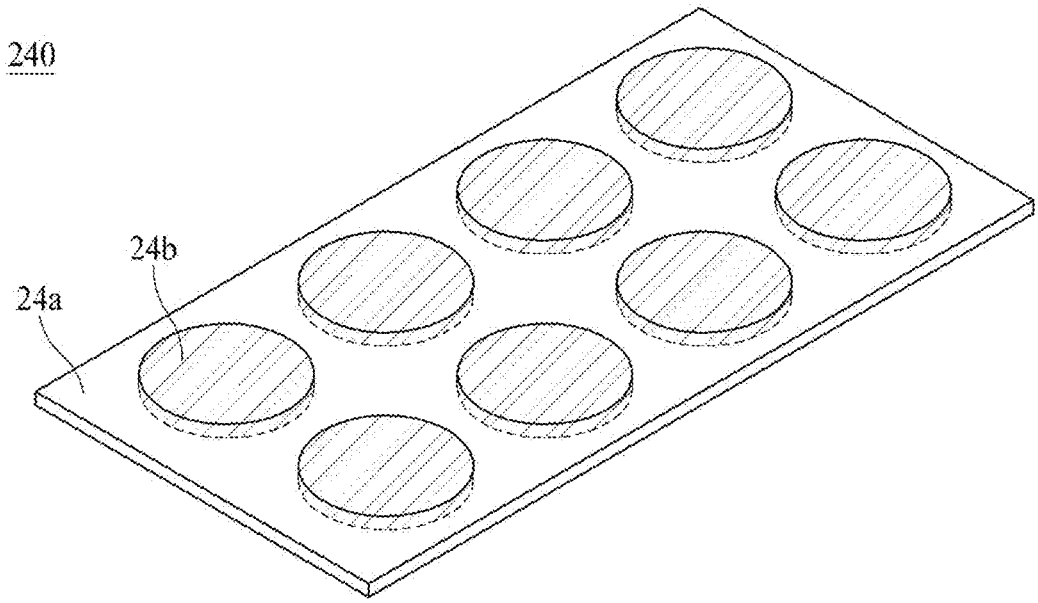

FIGS. 6A to 6C illustrate another example of a second structure of a sound generating device according to an embodiment of the present disclosure.

With reference to FIG. 6A, an inorganic material part of an width d1 and an organic material part of a width d2 of a sound generating device according to an embodiment of the present disclosure may be formed in a line pattern having the same width, and may be alternately disposed.

With reference to FIG. 6B, an inorganic material part of a width d1 and an organic material part of a width d2 of a sound generating device according to an embodiment of the present disclosure may be formed in a line pattern having different widths and may be alternately disposed. For example, a size of a first part 24*a* may be the same as or different from that of a second part 24*b*. When a width of the inorganic material part is greater than that of the organic material part, flexibility of the sound generating device may be reduced, but the sound generating device may have a high-pitched sound characteristic. Therefore, when a high-pitched sound characteristic is needed, a ratio of the inorganic material part may be adjusted to be higher than that of the organic material part. As another example, when the width of the inorganic material part is less than that of the organic material part, flexibility of the sound generating device may be good. Accordingly, when flexibility is needed, a ratio of the organic material part may be adjusted to be higher than that of the inorganic material part. For example, the sound generating device may be applied to a flexible display apparatus having a curve or a high curvature ratio.

With reference to FIG. 6C, an inorganic material part may be formed in a plurality of circular or oval patterns, and an organic material part may be disposed between one inorganic material part formed in a circular or oval pattern and another inorganic material part that is adjacent thereto and is formed in a circular or oval pattern. A display apparatus including a sound generating device having a structure illustrated in FIG. 6C may be adjusted in order for a display panel to have various shapes. Also, a plurality of circular, oval, or donut patterns may be a fine pattern capable of corresponding to various shapes, and when forms a circular, oval, or donut pattern, the pattern may be modified to correspond to various deformations of a display panel. Accordingly, a display apparatus may be implemented to have various shapes, and thus, a degree of freedom in design of a sound generating device based on a shape of the display apparatus may be enhanced and the sound generating device may be applied to a flexible display apparatus.

Figure 7A:
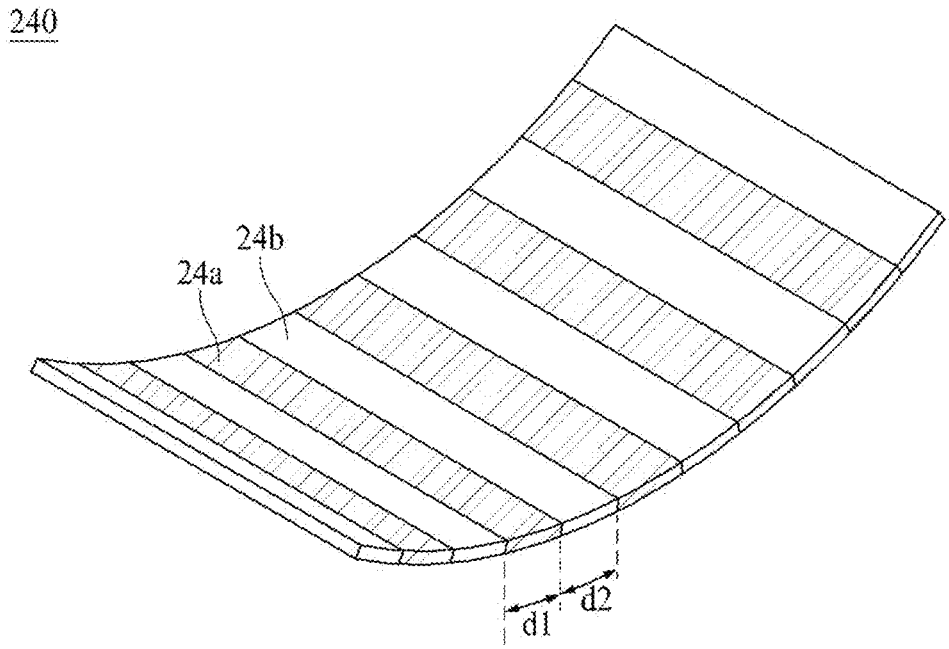
FIGS. 7A and 7B illustrate another example of a second structure of a sound generating device according to an embodiment of the present disclosure.
Figure 7B:
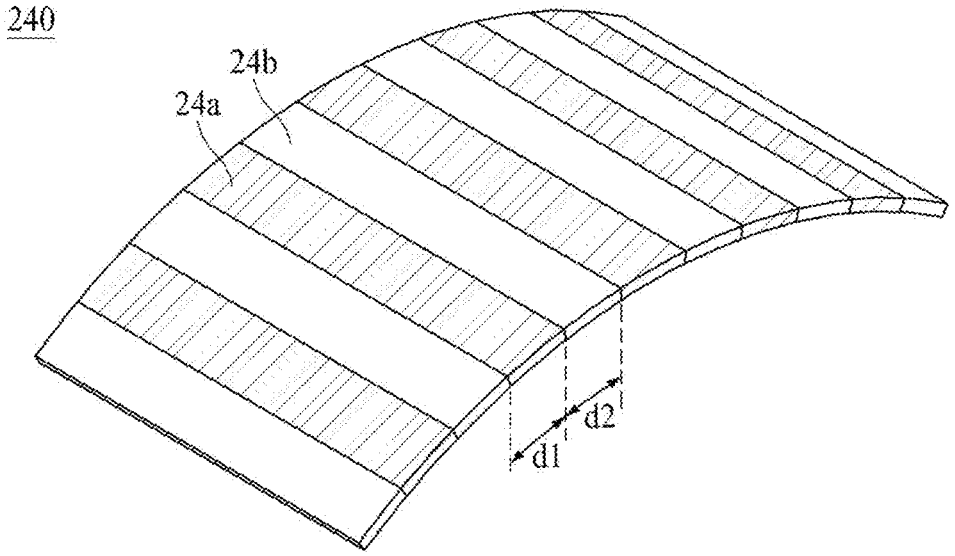

FIGS. 7A and 7B illustrate another example of a second structure of a sound generating device according to an embodiment of the present disclosure.

FIG. 7A illustrates an example where both ends of the inorganic material part and the organic material part of FIG. 6A are folded upward. FIG. 7A will be described with reference to FIG. 6A for example, and FIG. 6B may be similarly applied thereto.

FIG. 7B illustrates an example where the both ends of the inorganic material part and the organic material part of FIG. 6A are folded downward. FIG. 7B will be described with reference to FIG. 6A for example, and FIG. 6B may be identically applied thereto.

With reference to FIGS. 7A and 7B, in a sound generating device including an inorganic material part having a plurality of line patterns and an organic material part filling a space between adjacent inorganic material parts, even when both ends disposed at ends in a lengthwise direction of the plurality of line patterns are bent upward or downward, the inorganic material part may not be damaged or may not be reduced in performance. Therefore, a display apparatus including the sound generating device which includes the inorganic material part having a plurality of line patterns and the organic material part filling a space between adjacent inorganic material parts may be applied to a curved display apparatus having a certain curvature, but embodiments are not limited thereto and may be applied to a rollable display apparatus or a bendable display apparatus. The bendable display apparatus may be, for example, an edge bending display apparatus, but embodiments are not limited thereto. As another example, the display apparatus may be applied to a wearable display apparatus, for example, to wrap around one's wrist.

Figure 8A:
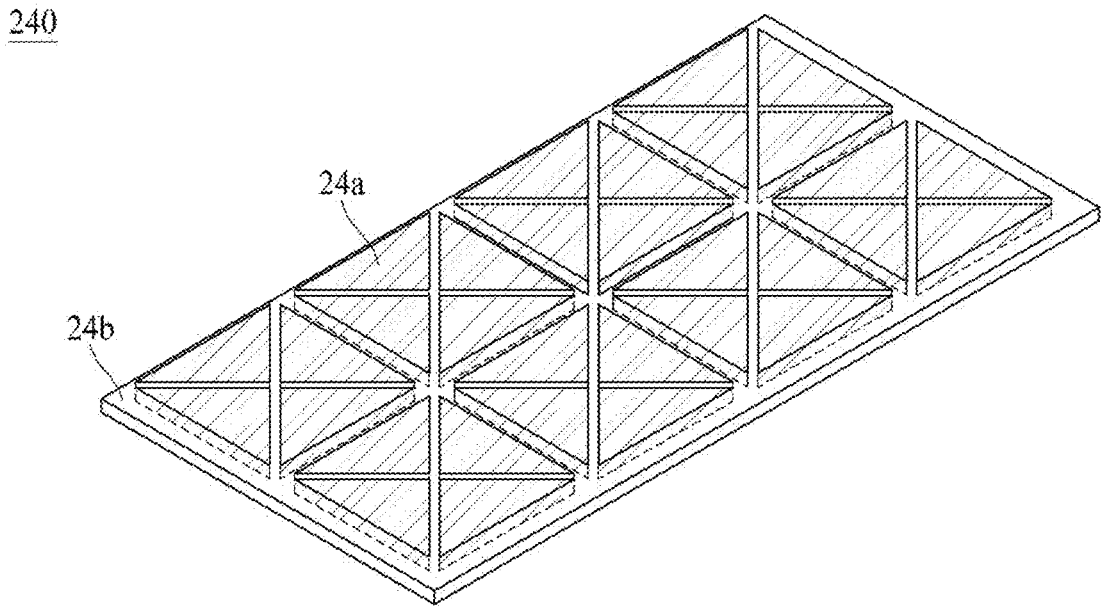
FIGS. 8A and 8B illustrate another example of a second structure of a sound generating device according to an embodiment of the present disclosure.
Figure 8B:
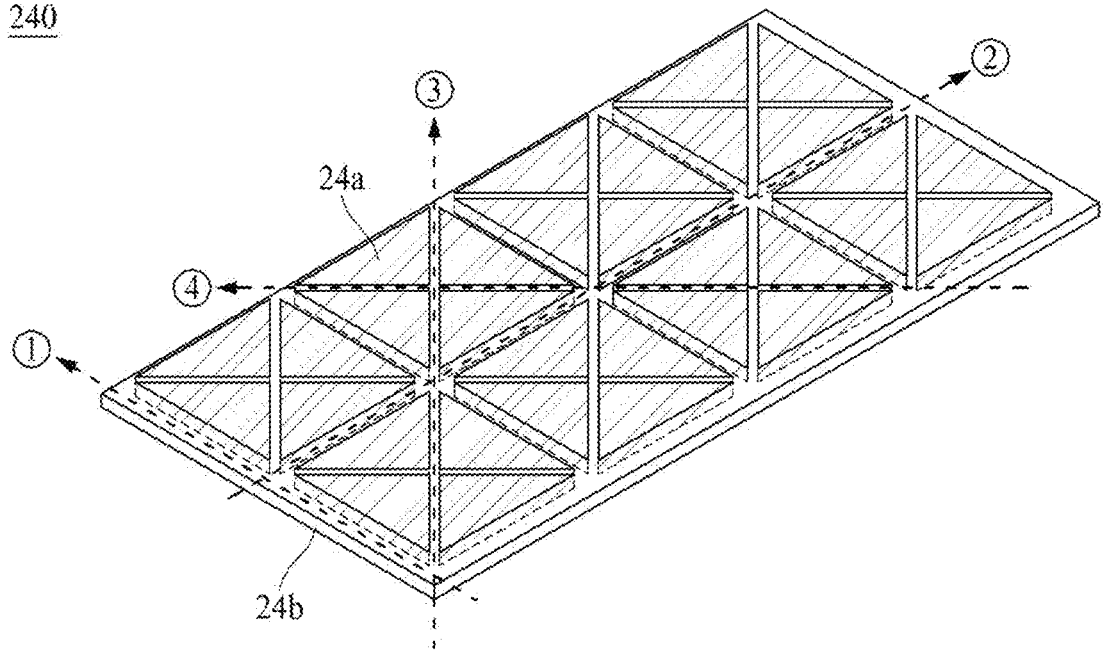

FIGS. 8A and 8B illustrate another example of a second structure of a sound generating device according to an embodiment of the present disclosure.

With reference to FIG. 8A, an inorganic material part may be formed in a plurality of triangular patterns, and an organic material part may be between one inorganic material part formed in a triangular pattern and another inorganic material part which is adjacent thereto and is formed in a triangular pattern. A display apparatus including a sound generating device having a structure illustrated in FIG. 8A may be adjusted in order for a display panel to have various shapes. Also, a plurality of triangular pattern patterns may be a fine pattern capable of corresponding to various shapes, and in a case which finely forms a triangular pattern, the pattern may be modified to correspond to various deformations of a display panel.

Therefore, a display apparatus including a sound generating device that includes an inorganic material part formed in a plurality of polygonal patterns or a plurality of circular patterns and an organic material part filling a space between adjacent inorganic material parts may be deformed based on various deformations or bending thereof and may be prevented from being damaged by deformation or may be prevented from being reduced in performance. Therefore, the display apparatus including the sound generating device that includes the inorganic material part formed in a plurality of polygonal patterns or a plurality of circular patterns and the organic material part filling a space between adjacent inorganic material parts may be applied to a curved display apparatus having a certain curvature, but embodiment are not limited thereto and may be applied to a rollable display apparatus or a bendable display apparatus. The bendable display apparatus may be, for example, an edge bending display apparatus, but embodiments are not limited thereto. As another example, the display apparatus may be applied to a wearable display apparatus, for example, to wrap around one's wrist.

FIG. 8B illustrates for describing a method of manufacturing the sound generating device of FIG. 8A. Numbers of FIG. 8B represent order in which an inorganic material part having a plate or sheet shape is formed and diced.

In FIG. 8B, ① and ② respectively represent dicing performed in a widthwise direction and dicing performed in a lengthwise direction on an inorganic material part. For example, the inorganic material part may move by a certain interval to correspond to a width or a shape of the inorganic material part which is set after dicing is performed once, and dicing may be performed a plurality of times or may be performed once or more. In FIG. 8B, ③ and ④ represent dicing performed in a diagonal direction on the inorganic material part. For example, the inorganic material part may move by a certain interval to correspond to a width or a shape of the inorganic material part which is set after dicing is performed once, and dicing may be performed a plurality of times or may be performed once or more. A method of dicing an inorganic material part is not limited thereto.

Figure 9A:
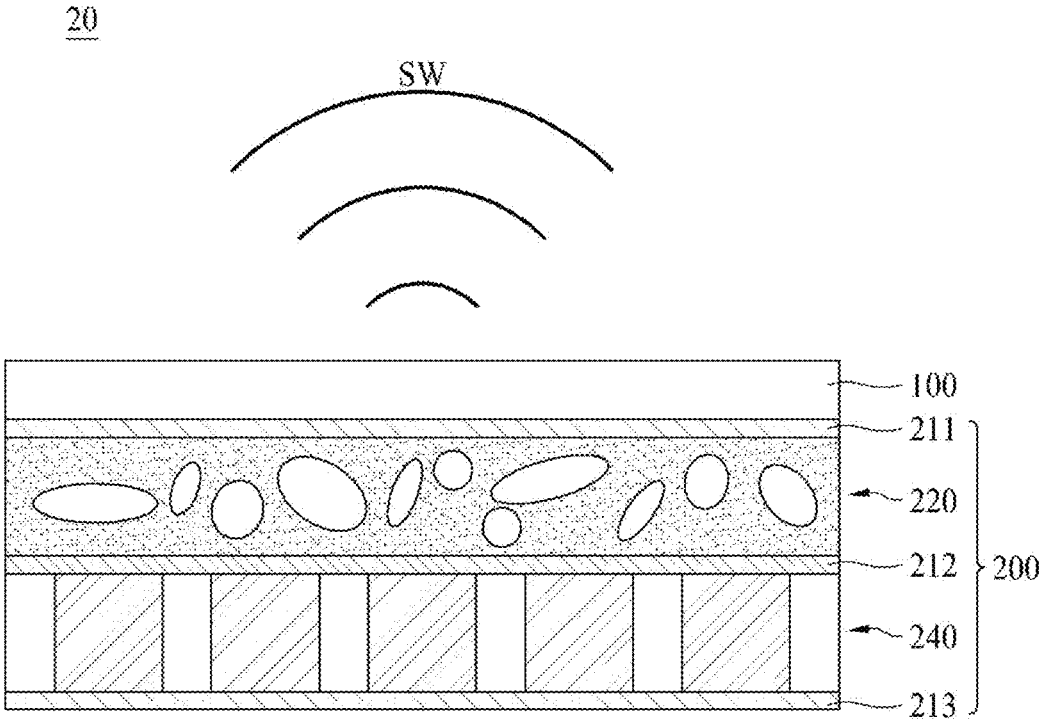
FIGS. 9A and 9B illustrate a display apparatus including a sound generating device according to an embodiment of the present disclosure.
Figure 9B:
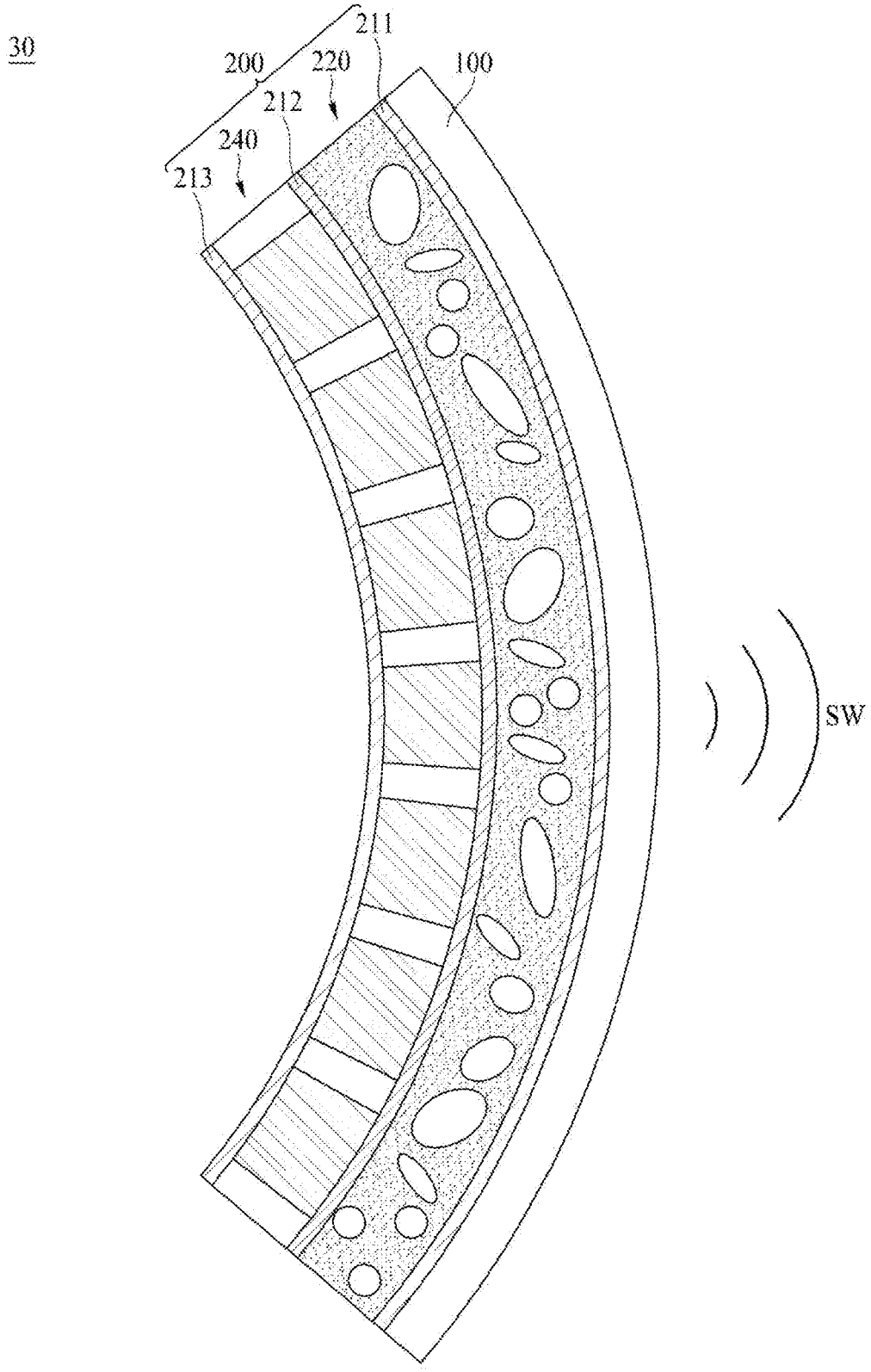

FIGS. 9A and 9B illustrate a display apparatus including a sound generating device according to an embodiment of the present disclosure.

With reference to FIG. 9A, a display apparatus 20 according to an embodiment of the present disclosure may include a display panel 100 and a sound generating device 200. The sound generating device 200 may include a first structure 220 and a second structure 240. The sound generating device 200 may include a first electrode 211 disposed over the first structure 220, a second electrode 212 disposed under the first structure 220, and a third electrode 213 disposed under the second structure 240. The sound generating device 200 may vibrate the display panel 100 to generate a sound SW. For example, the sound generating device 200 may directly vibrate the display panel 100 to output the sound SW toward a forward region in front of the display panel 100. The first structure 220 and the second structure 240 are as described above with reference to FIGS. 3 and 5 to 8B, and thus, their detailed descriptions may be omitted. An adhesive may be further provided between the display panel 100 and the first electrode 211. The adhesive may be, for example, an acrylic adhesive, an epoxy-based adhesive, and a silicon-based adhesive, and a functional group may be added to the adhesive so as to improve an adhesive force or a manufacturing process. However, embodiments are not limited thereto. Also, to improve an adhesive force to the display panel 100 and/or enhance an elastic modulus suitable for the first electrode 211, the adhesive may be used in common or mixed, or a thickness of the adhesive may be differently adjusted. However, embodiments are not limited thereto. A young's modulus of the first structure 220 may be less than that of the second structure 240. For example, the young's modulus of the first structure 220 may be 1 GPa or less, and a young's modulus of the second structure 240 may be less than 50 GPa. The first structure 220 having a low young's modulus may be disposed more adjacent to the display panel 100 than the second structure 240, and thus, an external impact may be reduced by the first structure 220. Accordingly, the first structure 220 may be disposed more adjacent to the display panel 100 than the second structure 240, thereby providing a display apparatus with enhanced impact resistance and flexibility.

With reference to FIG. 9B, a display apparatus 30 according to an embodiment of the present disclosure may include a display panel 100 and a sound generating device 200. The sound generating device 200 may include a first structure 220 and a second structure 240. The sound generating device 200 may vibrate the display panel 100 to generate a sound SW. For example, the sound generating device 200 may directly vibrate the display panel 100 to output the sound SW to a forward region in front of the display panel 100. The first structure 220 may be disposed more adjacent to the display panel 100 than the second structure 240. The sound generating device 200 may include the first structure 220, thereby providing a display apparatus with enhanced impact resistance and flexibility. Therefore, the sound generating device 200 may have flexibility, and thus, may be applied to a flexible display apparatus. A foldable display apparatus is illustrated as an example of the display apparatus 30. For example, an example where the display apparatus 30 is outward folded is illustrated. When the display panel 100 is folded outward, a compression stress may be released by the first structure 220 of the sound generating device 200 and may be transferred to the second structure 240, thereby providing a display apparatus with enhanced flexibility. Also, the first structure 220 of the sound generating device 200 may absorb impact energy against an external impact applied to the display panel 100 and may transfer remaining energy to the second structure 240, thereby providing a display apparatus with secured impact resistance. When the sound generating device 200 is applied to a foldable display apparatus, the display panel 100 may have a certain curvature radius in one direction, and the sound generating device 200 may be bent based on a curvature of the display panel 100. As another example, the sound generating device 200 according to an embodiment of the present disclosure may be applied to a bendable or rollable display apparatus.

Figure 10A:
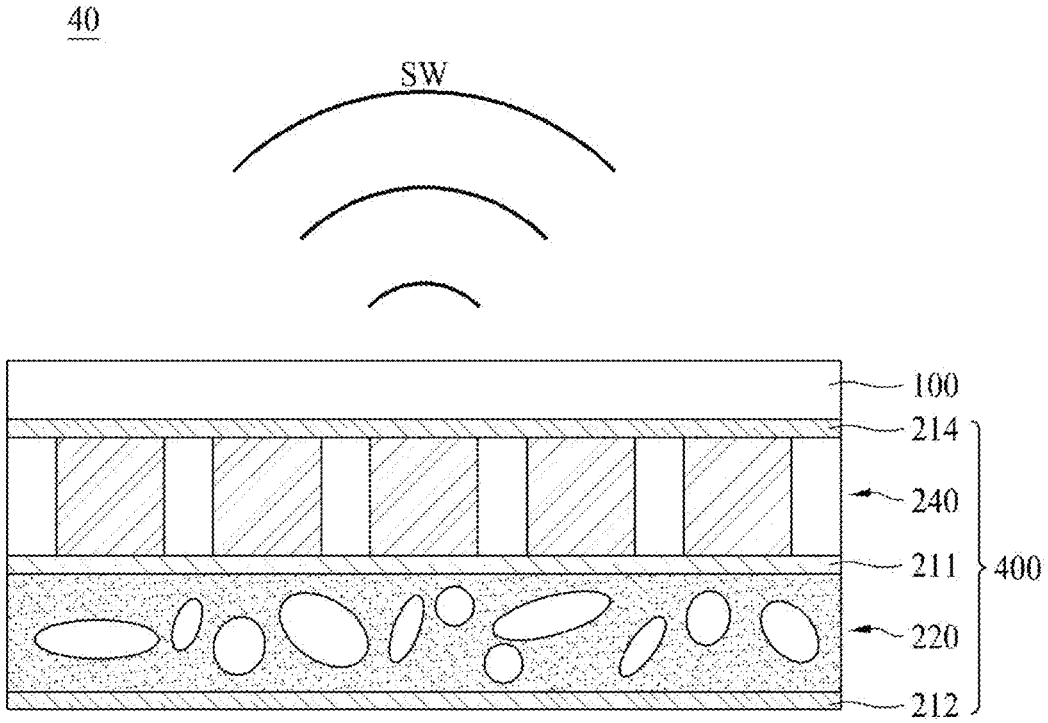
FIGS. 10A to 10C illustrate a display apparatus including a sound generating device according to an embodiment of the present disclosure.
Figure 10B:
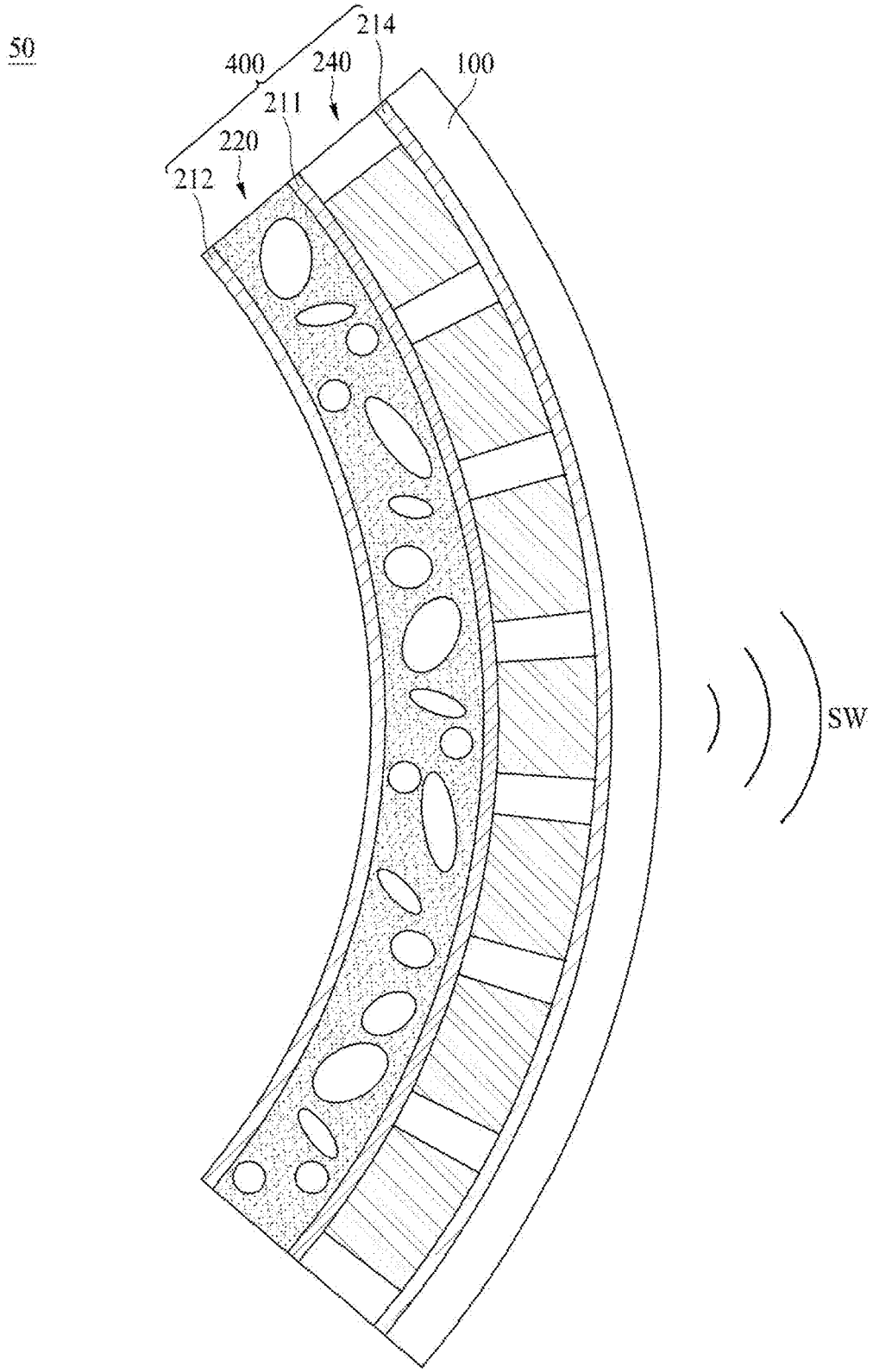
Figure 10C:
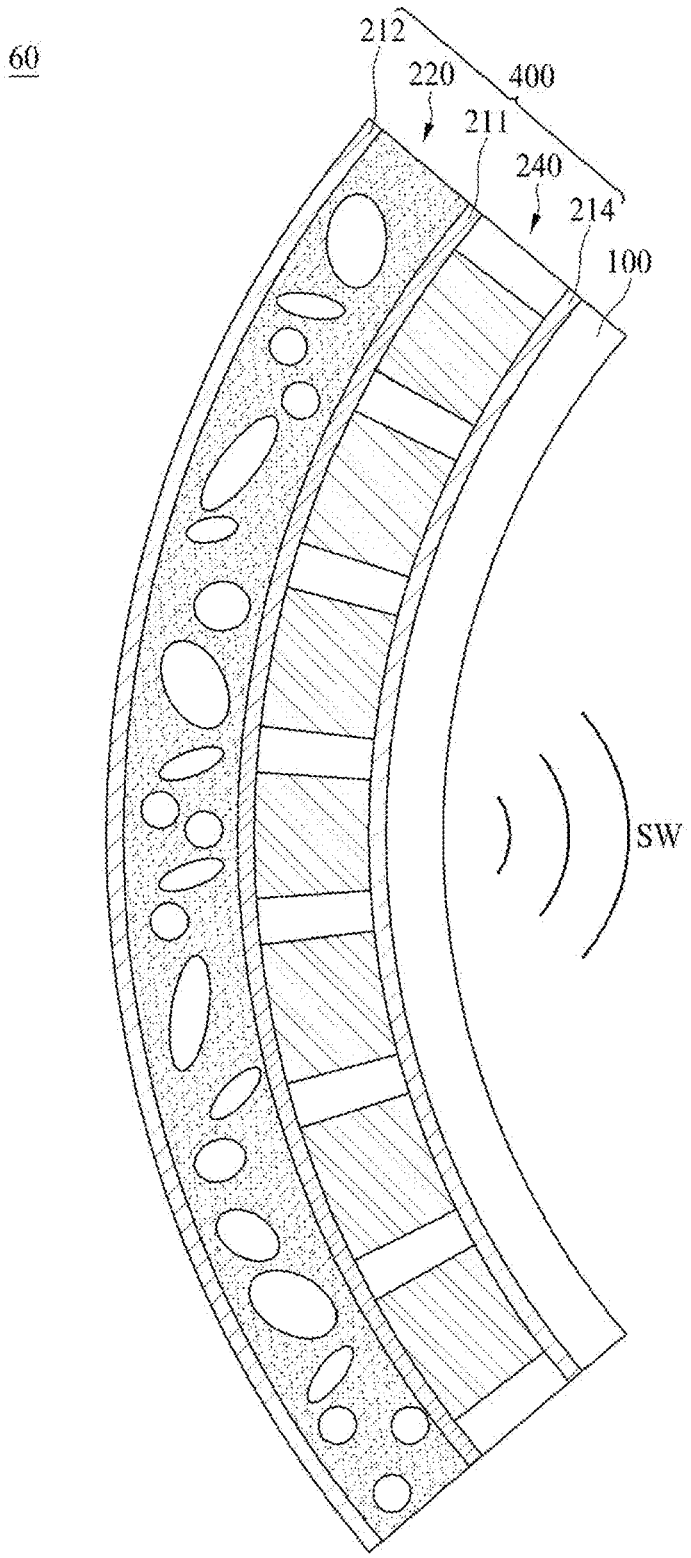

FIGS. 10A to 10C illustrate a display apparatus including a sound generating device according to an embodiment of the present disclosure.

With reference to FIG. 10A, a display apparatus 40 according to an embodiment of the present disclosure may include a display panel 100 and a sound generating device 400. The sound generating device 400 may include a first structure 220 and a second structure 240. The sound generating device 400 may include a first electrode 211 disposed over the first structure 220, a second electrode 212 disposed under the first structure 220, and a fourth electrode 214 disposed over the second structure 240. The sound generating device 400 may vibrate the display panel 100 to generate a sound SW. For example, the sound generating device 400 may directly vibrate the display panel 100 to output the sound SW to a forward region in front of the display panel 100. The first structure 220 and the second structure 240 are as described above with reference to FIGS. 3 and 5 to 8B, and thus, their detailed descriptions may be omitted. An adhesive may be further provided between the display panel 100 and the fourth electrode 214. The adhesive may be, for example, an acrylic adhesive, an epoxy-based adhesive, and a silicon-based adhesive, and a functional group may be added to the adhesive to improve an adhesive force or a manufacturing process. However, embodiments are not limited thereto. Also, to improve an adhesive force to the display panel 100 and/or enhance an elastic modulus suitable for the fourth electrode 214, the adhesive may be used in common or mixed, or a thickness of the adhesive may be differently adjusted. However, embodiments are not limited thereto. The second structure 240 may be disposed more adjacent to the display panel 100 than the first structure 220. Therefore, a vibration generated by the second structure 240 may be directly transferred to the display panel 100, and the loss of a vibration needed for generating a sound pressure may be minimized, thereby easily securing a sound pressure level suitable for a speaker. Also, since the loss of a vibration is minimized, an efficiency of generating a sound pressure may increase, and thus, a voltage applied to the sound generating device 400 may be reduced, thereby decreasing power consumption. Accordingly, the sound generating device 400 may have flexibility by using the first structure 220, thereby providing a sound generating device with enhanced flexibility and sound pressure level.

With reference to FIG. 10B, a display apparatus 50 according to an embodiment of the present disclosure may include a display panel 100 and a sound generating device 400. In a sound generating device using a voice coil or a piezoelectric ceramic, it is difficult to apply the sound generating device to a flexible display apparatus. For example, when a voice coil or a piezoelectric ceramic is applied to a sound generating device, a separate structure may be needed for applying the sound generating device to a flexible display apparatus, and due to this, since a thickness of a display apparatus is thickened or a flexible characteristic is limited to a certain level or less, a problem of a material should be solved. The sound generating device 400 according to an embodiment of the present disclosure may have flexibility, and thus, may be applied to a flexible display apparatus. A foldable display apparatus is illustrated as an example of the display apparatus 50. For example, an example where the display apparatus 50 is folded outward from the display panel 100 is illustrated. A compression stress which occurs when the display apparatus 50 is folded outward from the display panel 100 may be transferred to a first structure 220 through a second structure 240. A compression deformation rate based on the compression stress which occurs when the display apparatus 50 is folded outward from the display panel 100 may increase in a direction distancing from the display panel 100 corresponding to a point at which the compression stress occurs, and thus, the compression stress may be more efficiently released by the first structure 220 having flexibility, thereby providing a display apparatus with more enhanced flexibility.

With reference to FIG. 10C, an example where a display apparatus 60 according to an embodiment of the present disclosure is folded inward from a display panel 100 is illustrated. An expansive stress which occurs when the display apparatus 60 is folded inward from the display panel 100 may be transferred to a first structure 220 through a second structure 240. An expansion deformation rate based on the expansive stress which occurs when the display apparatus 60 is folded inward from the display panel 100 may increase in a direction distancing from the display panel 100 corresponding to a point at which the expansive stress occurs, and thus, the expansive stress may be more efficiently released by the first structure 220 having flexibility, thereby providing a display apparatus with more enhanced flexibility. When a sound generating device is applied to a foldable display apparatus, the display panel 100 may have a certain curvature radius in one direction, and the sound generating device may be bent based on a curvature of the display panel 100. As another example, a sound generating device 400 according to an embodiment of the present disclosure may be applied to a bendable or rollable display apparatus. Accordingly, a display apparatus with enhanced flexibility and sound pressure level may be provided.

As described above with reference to FIGS. 9A to 10C, when a sound generating device including a first structure and a second structure is provided, an impact resistance and flexibility may be secured, and flexibility and a sound pressure level may be enhanced. For example, when a display apparatus is configured with the sound generating device of FIGS. 9A and 9B, an impact resistance and flexibility may be secured, and when a display apparatus is configured with the sound generating device of FIGS. 10A to 10C, flexibility and a sound pressure level may be enhanced. Therefore, the present inventors have performed various experiments for implementing a sound generating device for enhancing an impact resistance, flexibility, and a sound pressure level. This will be described below with reference to FIGS. 11 to 14B.

Figure 11:
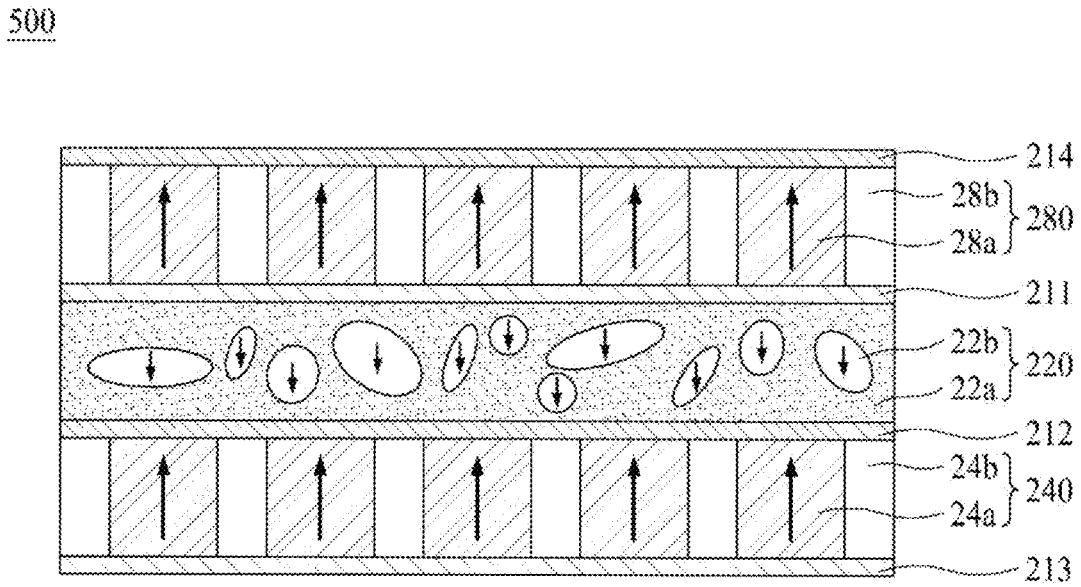
FIG. 11 illustrates a sound generating device according to an embodiment of the present disclosure.
Figure 12:
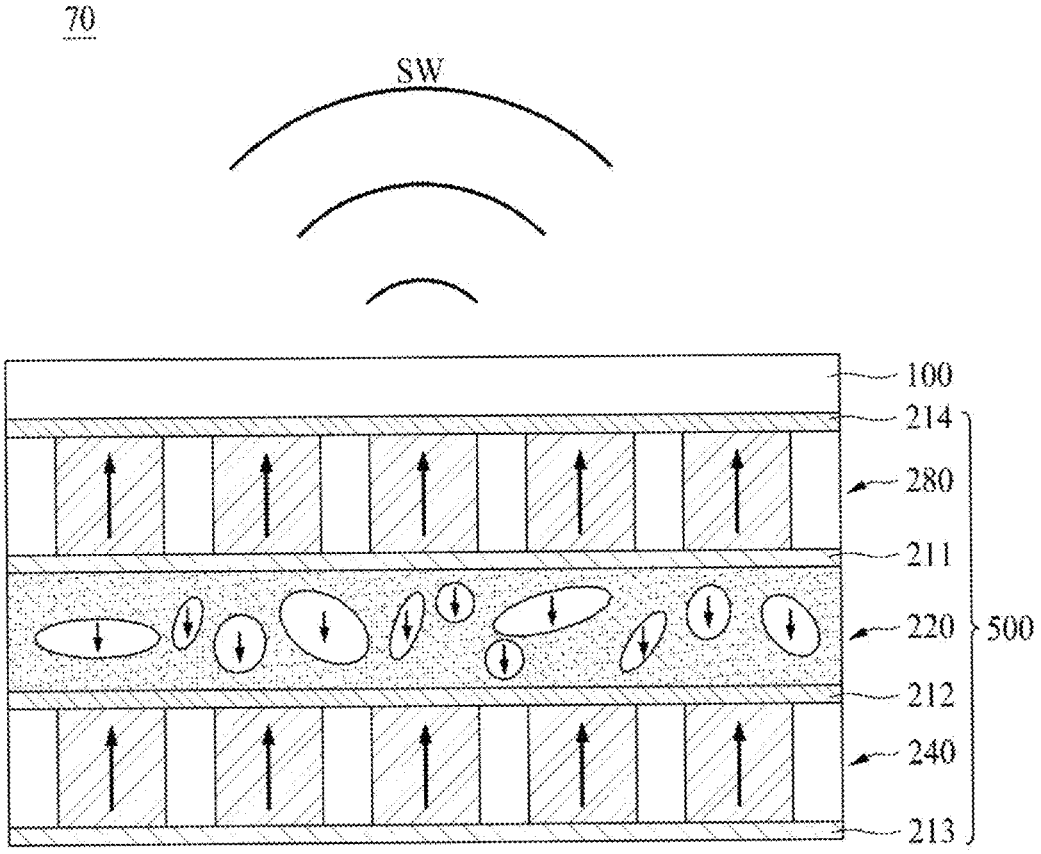
FIG. 12 illustrates a display apparatus including a sound generating device according to an embodiment of the present disclosure.

FIG. 11 illustrates a sound generating device according to an embodiment of the present disclosure. FIG. 12 illustrates a display apparatus including a sound generating device according to an embodiment of the present disclosure.

With reference to FIGS. 11 and 12, a display apparatus 70 according to an embodiment of the present disclosure may include a display panel 100 and a sound generating device 500. The sound generating device 500 may include a first structure 220, a second structure 240, and a third structure 280. The first structure 220 and the second structure 240 are as described above with reference to FIGS. 3 and 5 to 9B, and thus, their detailed descriptions may be omitted or may be briefly given below. When the first structure 220 is provided more adjacent to the display panel 100 than the second structure 240, an impact resistance and flexibility may be enhanced by the first structure 220. In such a structure, a sound pressure level may not be secured. Therefore, the present inventors have performed various experiments for placing a third structure so as to more enhance a sound pressure level of a sound generating device. To more enhance the sound pressure level of the sound generating device, the third structure may be disposed over the first structure, and the third structure may be disposed to have the same configuration as that of the second structure. The third structure 280 may be disposed over the first structure 220. As another example, the third structure 280 may be disposed under the second structure 240 or over the second structure 240. The third structure 280 may have the same configuration as that of the second structure 240. For example, the third structure 280 may include a first part 28*a* and a second part 28*b* between adjacent first parts 28*a*. The first part 28*a* may include an inorganic material part, and the second part 28*b* may include an organic material part. The sound generating device 500 may vibrate the display panel 100 to generate sound SW. For example, the sound generating device 500 may directly vibrate the display panel 100 to output the sound SW to a forward region in front of the display panel 100. Therefore, since the third structure 280 is further provided, a vibration generated by the third structure 280 may be directly transferred to the display panel 100, and the loss of a vibration needed for generating a sound pressure may be minimized, thereby easily securing a sound pressure level suitable for a speaker. Also, since the loss of a vibration is minimized, an efficiency of generating a sound pressure may increase, and thus, a voltage applied to the sound generating device 500 may be reduced, thereby decreasing power consumption.

The sound generating device 500 may include a first electrode 211 disposed over the first structure 220, a second electrode 212 disposed under the first structure 220, a third electrode 213 disposed under the second structure 240, and a fourth electrode 214 disposed over the second structure 240. An adhesive may be further provided between the display panel 100 and the fourth electrode 214. The adhesive may be, for example, an acrylic adhesive, an epoxy-based adhesive, and a silicon-based adhesive, and a functional group may be added to the adhesive to improve an adhesive force or a manufacturing process. However, embodiments are not limited thereto. Also, to improve an adhesive force to the display panel 100 and/or enhance an elastic modulus suitable for the fourth electrode 214, the adhesive may be used in common or mixed, or a thickness of the adhesive may be differently adjusted. However, embodiments are not limited thereto.

The first electrode 211, the second electrode 212, the third electrode 213, and the fourth electrode 214 may apply a voltage to the first structure 220, the second structure 240, and the third structure 280. For example, the first electrode 211 and the third electrode 213 may be a positive (+) electrode, and the second electrode 212 and the fourth electrode 214 may be a negative (−) electrode. As another example, the first electrode 211 and the third electrode 213 may be a negative (−) electrode, and the second electrode 212 and the fourth electrode 214 may be a positive (+) electrode. For example, the first electrode 211, the second electrode 212, the third electrode 213, and the fourth electrode 214 may include one or more of carbon (C), palladium (Pd), iron (Fe), tin (Sn), aluminum (Al), nickel (Ni), platinum (Pt), gold (Au), silver (Ag), copper (Cu), titanium (Ti), and molybdenum (Mo), or an alloy thereof, but embodiments are not limited thereto. For example, the first electrode 211, the second electrode 212, the third electrode 213, and the fourth electrode 214 may include ITO or a Mo—Ti alloy, but embodiments are not limited thereto.

When an AC voltage is applied to the first electrode 211, the second electrode 212, the third electrode 213, and the fourth electrode 214 of the sound generating device 500, the first structure 220, the second structure 240, and the third structure 280 may alternately and repeatedly expand and contract, thereby generating a vibration based on a bending phenomenon where a bending direction is alternately changed. The display panel 100 may vibrate based on the generated vibration to generate sound. The display panel 100 may vibrate with kinetic energy based on polarization which is performed in a direction vertical to the display panel 100. Therefore, polarization performed in a vector direction except the direction vertical to the display panel 100 may be lost. A whole vibration of the sound generating device 500 may be affected by summated energy in the vector direction vertical to the display panel 100, and thus, a polarization direction (illustrated by an arrow) of the first structure 220, a polarization direction (illustrated by an arrow) of the second structure 240, and a polarization direction (illustrated by an arrow) of the third structure 280 may be a direction vertical to the display panel 100. The display panel 100 may vibrate based on the expansion and contraction of the first structure 220, the second structure 240, and the third structure 280, and thus, when a polarization direction of the first structure 220 is opposite to that of the second structure 240 and the third structure 280, a sound pressure level of the sound generating device 500 may be enhanced. The second structure 240 and the third structure 280 may form a polarization direction vertical to the display panel 100, and the polarization direction of the first structure 220 may be aligned in a direction vertical to the display panel 100, thereby increasing a vibration of the sound generating device 500. Accordingly, a sound pressure level of the display apparatus 70 including the sound generating device 500 may be further enhanced.

Figure 13:
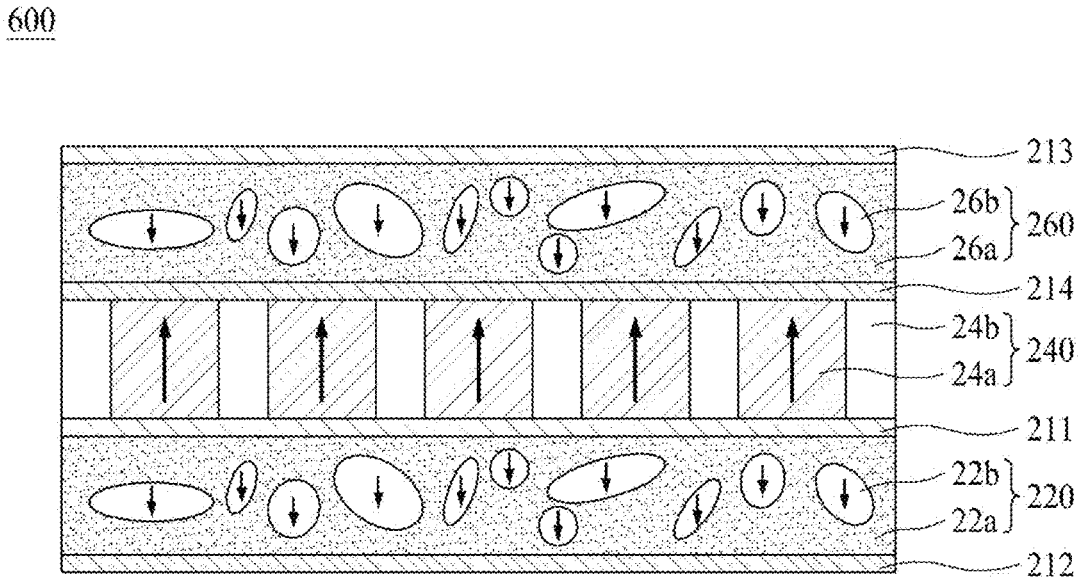
FIG. 13 illustrates a sound generating device according to an embodiment of the present disclosure.
Figure 14A:
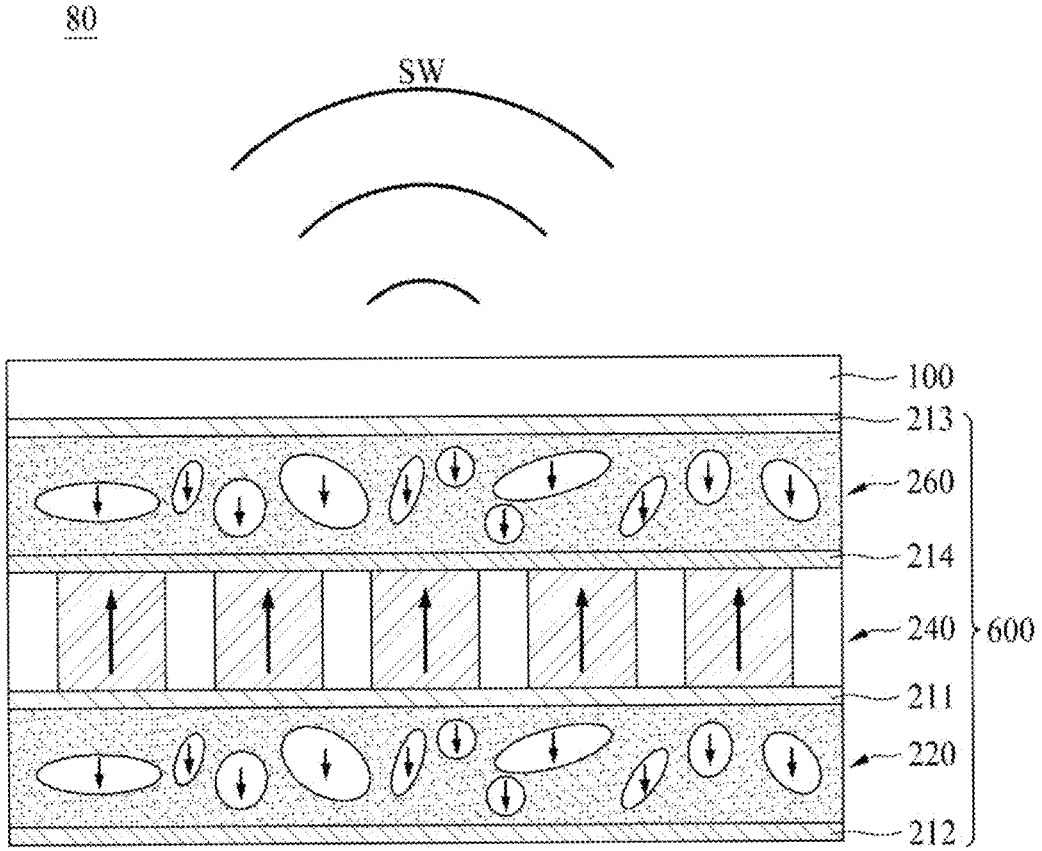
FIGS. 14A and 14B illustrate a display apparatus including a sound generating device according to an embodiment of the present disclosure.
Figure 14B:
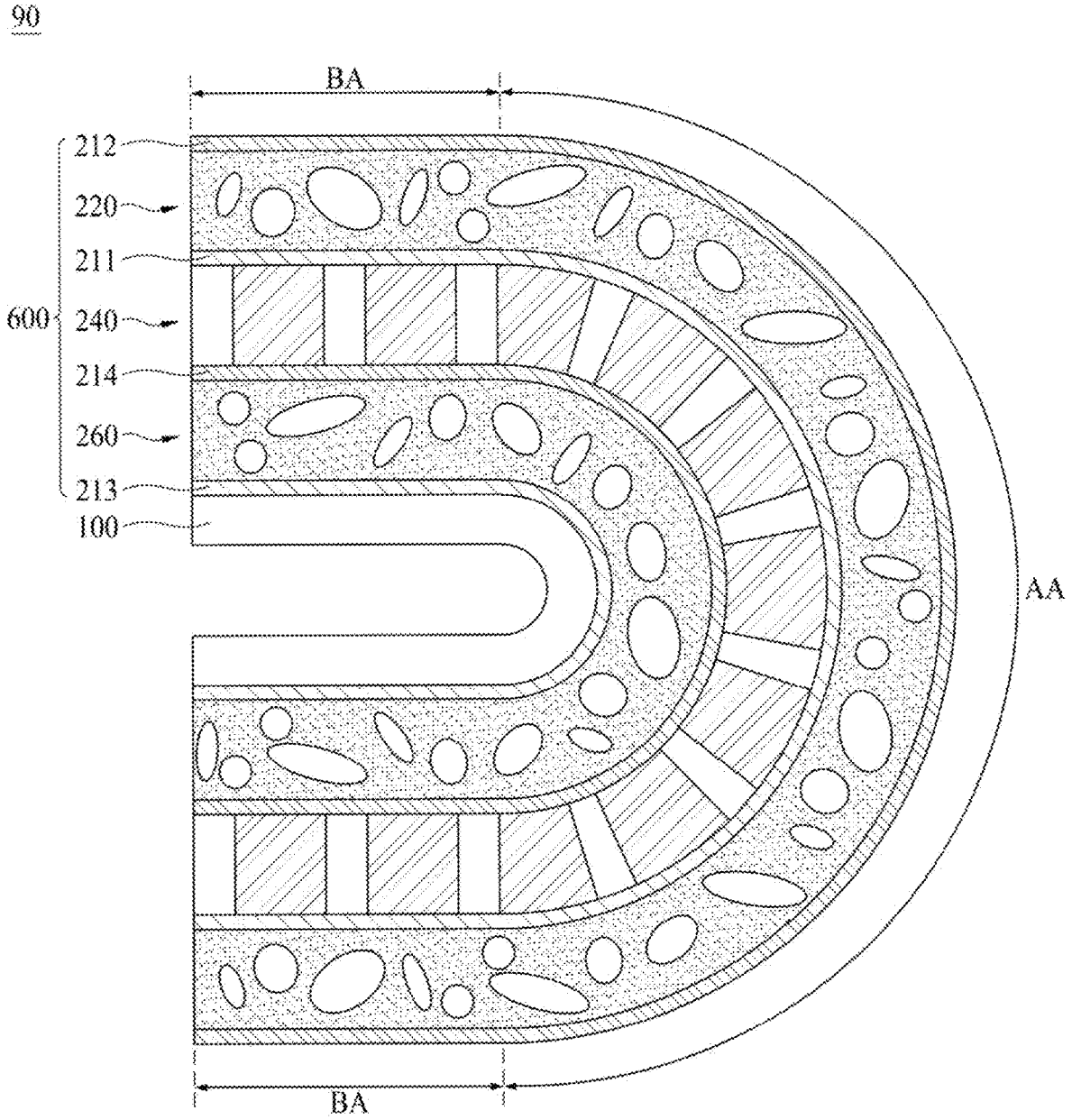

FIG. 13 illustrates a sound generating device according to an embodiment of the present disclosure. FIGS. 14A and 14B illustrate a display apparatus including a sound generating device according to an embodiment of the present disclosure.

With reference to FIGS. 13 and 14A, a display apparatus 80 according to an embodiment of the present disclosure may include a display panel 100 and a sound generating device 600. The sound generating device 600 may include a first structure 220, a second structure 240, and a third structure 260. The first structure 220 and the second structure 240 are as described above with reference to FIGS. 3, 5 to 8B, and 10A to 10C, and thus, their detailed descriptions may be omitted or may be briefly given below. When the second structure 240 is provided more adjacent to the display panel 100 than the first structure 220, a sound pressure level and flexibility may be enhanced by the second structure 240. In such a structure, an impact resistance may not be secured. Therefore, the present inventors have performed various experiments for placing a third structure to more enhance an impact resistance of a sound generating device. To more enhance the impact resistance of the sound generating device, the third structure may be disposed over the second structure, and the third structure may be disposed to have the same configuration as that of the first structure. For example, the third structure 260 may be disposed under or over the second structure 240. As another example, the third structure 260 may be disposed under or over the first structure 220. The third structure 260 may be disposed to have the same configuration as that of the first structure 220. For example, the third structure 260 may include a polymer matrix 26*a* and a piezoelectric material 26*b* included in the polymer matrix 26*a*. The piezoelectric material 26*b* may be dispersed in the polymer matrix 26*a*. The sound generating device 600 may vibrate the display panel 100 to generate sound SW. For example, the sound generating device 600 may directly vibrate the display panel 100 to output the sound SW to a forward region in front of the display panel 100. Therefore, since the third structure 260 is further provided, a sound generating device with more enhanced impact resistance may be provided, thereby providing a display apparatus including a sound generating device with enhanced impact resistance, flexibility, and sound pressure level.

The sound generating device 600 may include a first electrode 211 disposed over the first structure 220, a second electrode 212 disposed under the first structure 220, a fourth electrode 214 disposed over the second structure 240, and a third electrode 213 disposed over the third structure 260. An adhesive may be further provided between the display panel 100 and the third electrode 213. The adhesive may be, for example, an acrylic adhesive, an epoxy-based adhesive, and a silicon-based adhesive, and a functional group may be added to the adhesive to improve an adhesive force or a manufacturing process. However, embodiments are not limited thereto. Also, to improve an adhesive force to the display panel 100 and/or enhance an elastic modulus suitable for the third electrode 213, the adhesive may be used in common or mixed, or a thickness of the adhesive may be differently adjusted. However, embodiments are not limited thereto.

The first electrode 211, the second electrode 212, the third electrode 213, and the fourth electrode 214 may apply a voltage to the first structure 220, the second structure 240, and the third structure 260. For example, the first electrode 211 and the third electrode 213 may be a positive (+) electrode, and the second electrode 212 and the fourth electrode 214 may be a negative (−) electrode. As another example, the first electrode 211 and the third electrode 213 may be a negative (−) electrode, and the second electrode 212 and the fourth electrode 214 may be a positive (+) electrode. For example, the first electrode 211, the second electrode 212, the third electrode 213, and the fourth electrode 214 may include one or more of carbon (C), palladium (Pd), iron (Fe), tin (Sn), aluminum (Al), nickel (Ni), platinum (Pt), gold (Au), silver (Ag), copper (Cu), titanium (Ti), and molybdenum (Mo), or an alloy thereof, but embodiments are not limited thereto. For example, the first electrode 211, the second electrode 212, the third electrode 213, and the fourth electrode 214 may include ITO or a Mo—Ti alloy, but embodiments are not limited thereto.

When an AC voltage is applied to the first electrode 211, the second electrode 212, the third electrode 213, and the fourth electrode 214 of the sound generating device 600, the first structure 220, the second structure 240, and the third structure 260 may alternately and repeatedly expand and contract, thereby generating a vibration based on a bending phenomenon where a bending direction is alternately changed. The display panel 100 may vibrate based on the generated vibration to generate a sound. The display panel 100 may vibrate with kinetic energy based on polarization which is performed in a direction vertical to the display panel 100. Therefore, polarization performed in a vector direction except the direction vertical to the display panel 100 may be lost. A whole vibration of the sound generating device 600 may be affected by summated energy in the vector direction vertical to the display panel 100, and thus, a polarization direction (illustrated by an arrow) of the first structure 220, a polarization direction (illustrated by an arrow) of the second structure 240, and a polarization direction (illustrated by an arrow) of the third structure 260 may be a direction vertical to the display panel 100. The display panel 100 may vibrate based on the expansion and contraction of the first structure 220, the second structure 240, and the third structure 260, and thus, when a polarization direction of the second structure 240 is opposite to that of the first structure 220 and the third structure 260, a sound pressure level of the sound generating device 600 may be enhanced. The second structure 240 may form a polarization direction vertical to the display panel 100, and the polarization direction of the first structure 220 and the third structure 260 may be aligned in a direction vertical to the display panel 100, thereby increasing a vibration of the sound generating device 600. Accordingly, a sound pressure level of the sound generating device 600 may be more enhanced. When the third structure 260 is disposed more adjacent to the display panel 100 than the second structure 240, flexibility may be enhanced by the first structure 220 and the third structure 260, and an impact resistance may be enhanced by the third structure 260. Accordingly, a display apparatus including a sound generating device with enhanced impact resistance, flexibility, and sound pressure level may be provided.

With reference to FIG. 14B, a display apparatus 90 according to an embodiment of the present disclosure may include a display panel 100 and a sound generating device 600. The sound generating device 600 is as described above with reference to FIGS. 13 and 14A, and thus, its detailed description is omitted or will be briefly given below. In a sound generating device using a voice coil or a piezoelectric ceramic, it is difficult to apply the sound generating device to a flexible display apparatus. For example, when a voice coil or a piezoelectric ceramic is applied to a sound generating device, a separate structure may be needed for applying the sound generating device to a flexible display apparatus, and due to this, since a thickness of a display apparatus is thickened or a flexible characteristic is limited to a certain level or less, a problem of a material should be solved. As described above with reference to FIGS. 13 and 14A, the sound generating device 600 according to an embodiment of the present disclosure may have an impact resistance and flexibility, and thus, may be applied to a flexible display apparatus. A foldable display apparatus is illustrated as an example of the display apparatus 90. An example where the display apparatus 90 is a foldable display apparatus is illustrated. For example, an example where the display apparatus 90 is folded inward from the display panel 100 is illustrated. When first structure 220 is disposed more adjacent to the display panel 100 than the second structure 240, an expansive stress may be released in the first structure 220 and the third structure 260 when the display apparatus 90 is folded inward from the display panel 100 and may be transferred to a second structure 240, thereby more securing flexibility. Therefore, flexibility may be enhanced by the first structure 220 and the third structure 260, and when an external impact is applied, first structure 220 and the third structure 260 may act as a protection layer for the second structure 240, thereby enhancing an impact resistance of the sound generating device 600. In FIG. 14B, an example where a display panel is inward folded is illustrated, but an embodiment of the present disclosure may be applied to a display apparatus where a display panel is folded outward. When the display apparatus 90 is folded outward from the display panel 100, an compression stress may be released in the first structure 220 and the third structure 260 and may be transferred to the second structure 240, thereby more securing flexibility.

When a display panel is folded inward, a bending area BA may be bent to have a semicircular shape. A folded area may be the bending area BA. The bending area BA may be an area where a flexible substrate is bent. The flexible substrate may be formed of an insulating material having flexibility. For example, the flexible substrate may be formed of plastic such as polyimide, but embodiments are not limited thereto. Also, at least one back plate for supporting the flexible substrate may be further provided under the flexible substrate. The back plate may be formed as a plastic thin film which is formed of polyimide, polyethylene napthalate (PEN), polyethylene terephthalate (PET), other suitable polymers, or a combination thereof, but embodiment are not limited thereto. The flexible substrate may be configured so that the flexible substrate is maintained in a flat state without being bent in an area other than the bending area and only the bending area is bent. Therefore, the sound generating device 500 may be disposed along the bending area BA and a display area AA. For example, the sound generating device 600 may be disposed to have a curve surface that is bent based on the bending area BA. When the display panel 100 has a certain curvature radius in one direction, the sound generating device 600 may be bent based on a curvature of the display panel 100. When the sound generating device 600 is applied to a rollable display apparatus, the display panel 100 may be wound or unwound, the sound generating device 600 may be disposed based on winding or unwinding of the display panel 100. Therefore, the sound generating device according to an embodiment of the present disclosure may be applied to a plastic electroluminescent display apparatus, a flexible display apparatus, a bendable display apparatus, a foldable display apparatus, a rollable display apparatus, etc. As another example, the sound generating device according to an embodiment of the present disclosure may be applied to a wearable display apparatus, for example, to wrap around one's wrist.

Figure 15:
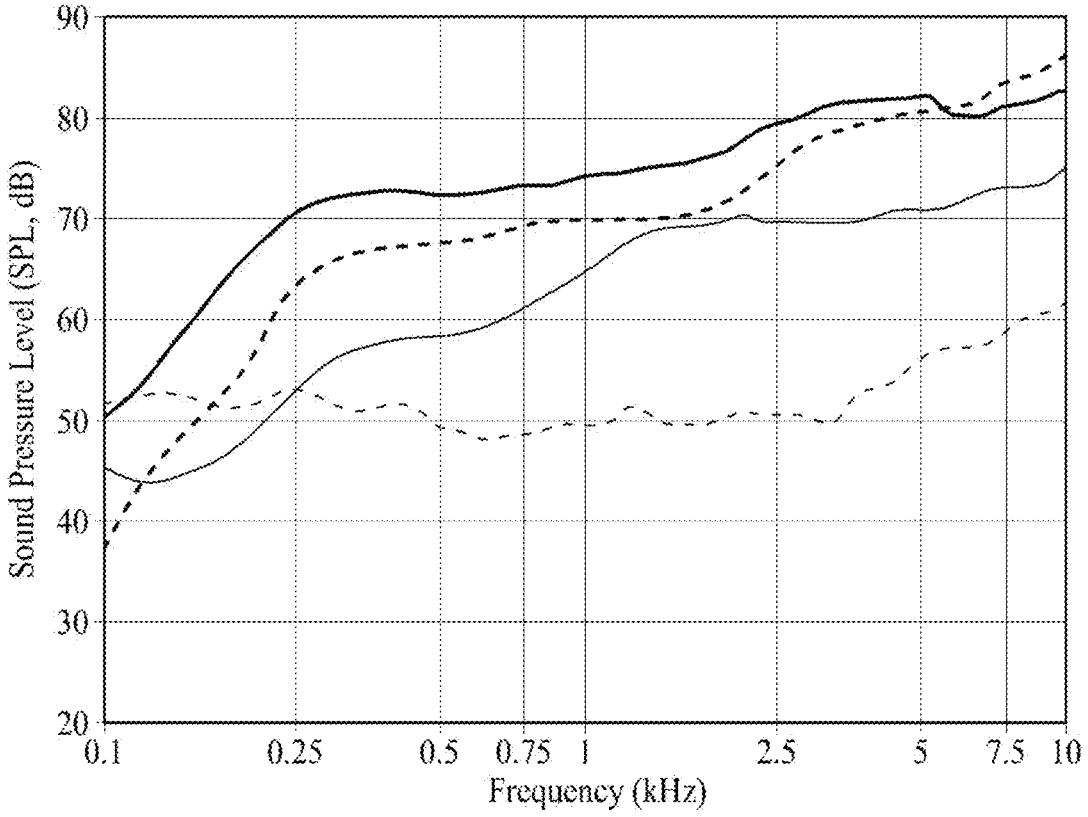
FIG. 15 illustrates a sound output characteristic of a sound generating device according to an embodiment of the present disclosure.

FIG. 15 illustrates a sound output characteristic of a sound generating device according to an embodiment of the present disclosure.

In FIG. 15, the abscissa axis (x-axis) represents a frequency in hertz (Hz), and the ordinate axis (y-axis) represents a sound pressure level (SPL) in decibel (dB). A sound output characteristic has been measured in an anechoic chamber which is closed in all directions, and measurement equipment has used Audio Precision company's APX525. Measurement has been performed under a condition where a driving voltage is 10.6 Vrms and a sound pressure level measurement distance to a center of a sound generating module is about 10 cm. An applied frequency signal has been applied as a sine sweep within a range of 200 Hz to 20 kHz, and ⅓ octave smoothing has been performed on a measurement result. A measurement method is not limited thereto.

In FIG. 15, a thin dot line represents an example where only a first structure is applied, and a thin solid line represents an example where only a second structure is applied. A thick dot line represents a display apparatus to which a sound generating device according to an embodiment (FIG. 9A) of the present disclosures is applied, and a thick solid line represents a display apparatus to which a sound generating device according to an embodiment (FIG. 13) of the present disclosures is applied. A polymer matrix of the first structure may be formed of PVDF, a piezoelectric material of the first structure may be formed of $BaTiO_3$, and an electrode may be formed of MoTi. However, the materials are not limited thereto. A first part of the second structure may be formed of $PbZrTiO_3$, a second part of the second structure may be formed of epoxy, and an electrode may be formed of MoTi. However, the materials are not limited thereto. The sound generating device 200 according to an embodiment of the present disclosure may include the first structure and the second structure, and the sound generating device 600 according to an embodiment of the present disclosure may include the first structure, the second structure, and the third structure. Also, even when the sound generating device 400 according to an embodiment of the present disclosure and the sound generating device 500 according to an embodiment of the present disclosure are applied, the same result or a similar result may be obtained as a sound output characteristic.

With reference to FIG. 15, when only a first structure is applied, it may be seen that a sound pressure level is low in a whole frequency domain. When only a second structure is applied, it may be seen that a sound pressure level increases compared to the first structure. In comparison with a case where only the first structure is applied, when the first structure and the second structure of the sound generating device 200 according to an embodiment of the present disclosure are applied, it may be seen that a sound pressure level is enhanced in a frequency domain of about 0.2 kHz or higher, and it may be seen that a sound pressure level increase by about 20 dB to about 30 dB in a frequency band of 1 kHz to 3 kHz occupying a large part of frequency band in an audible sound of a sound generating device which is a speaker. In comparison with a case where only the second structure is applied, when the first structure and the second structure of the sound generating device 200 according to an embodiment of the present disclosure are applied, it may be seen that a sound pressure level is enhanced in a frequency domain of about 0.2 kHz or more, and it may be seen that a sound pressure level increase by about 5 dB to about 10 dB in a frequency band of 1 kHz to 3 kHz occupying a large part of frequency band in an audible sound of a sound generating device which is a speaker. In comparison with a case where only the first structure is applied, when the first structure, the second structure, and the third structure of the sound generating device 600 according to an embodiment of the present disclosure are applied, it may be seen that a sound pressure level increase by about 25 dB to about 30 dB in a frequency band of 1 kHz to 3 kHz occupying a large part of frequency band in an audible sound of a sound generating device which is a speaker, and since a sound pressure level increase by about 10 dB to about 20 dB in a low frequency domain of 200 Hz to 500 Hz corresponding to a drawback of a piezoelectric speaker, it may be seen that a total sound pressure characteristic is enhanced. In comparison with a case where only the second structure is applied, when the first structure, the second structure, and the third structure of the sound generating device 600 according to an embodiment of the present disclosure are applied, it may be seen that a sound pressure level increase by about 10 dB or more in a frequency band of 1 kHz to 3 kHz occupying a large part of frequency band in an audible sound of a sound generating device which is a speaker, and since a sound pressure level increase by about 10 dB to about 20 dB in a low frequency domain of 200 Hz to 500 Hz corresponding to a drawback of a piezoelectric speaker, it may be seen that a total sound pressure characteristic is enhanced. In comparison with a case where the first structure and the second structure are applied, when the first structure, the second structure, and the third structure of the sound generating device 600 according to an embodiment of the present disclosure are applied, it may be seen that a sound pressure level increase by about 5 dB to about 20 dB in a frequency band of 1 kHz to 3 kHz occupying a large part of frequency band in an audible sound of a sound generating device which is a speaker, and since a sound pressure level increase by about 10 dB to about 20 dB to about 20 dB in a low frequency domain of 200 Hz to 500 Hz corresponding to a drawback of a piezoelectric speaker, it may be seen that a total sound pressure characteristic is enhanced. Therefore, the sound generating device according to an embodiment of the present disclosure may have an excellent vibration characteristic for enhancing a sound pressure level in a whole frequency domain, thereby providing a sound generating device having flexibility and an impact resistance. Also, the sound generating device according to an embodiment of the present disclosure may enhance a sound pressure level in a whole frequency domain, thereby providing a sound generating device capable of being applied to a display apparatus.

A sound generating device according to an embodiment of the present disclosure may be applied as a sound generating device in a display apparatus. A display apparatus according to an embodiment of the present disclosure may be applied to mobile apparatuses, video phones, smart watches, watch phones, wearable apparatuses, foldable apparatuses, rollable apparatuses, bendable apparatuses, flexible apparatuses, curved apparatuses, portable multimedia players (PMPs), personal digital assistants (PDAs), electronic organizers, desktop personal computers (PCs), laptop PCs, netbook computers, workstations, navigation apparatuses, automotive navigation apparatuses, automotive display apparatuses, TVs, wall paper display apparatuses, signage apparatuses, game machines, notebook computers, monitors, cameras, camcorders, home appliances, etc. Also, the sound generating device according to an embodiment of the present disclosure may be applied to organic light emitting lighting apparatuses or inorganic light emitting lighting apparatuses. When the sound generating device is applied to a lighting apparatus, the sound generating device may act as lighting and a speaker.

A display apparatus according to an embodiment of the present disclosure will be described below.

According to an embodiment of the present disclosure, a display apparatus includes a display panel configured to display an image and a sound generating device on a rear surface of the display panel, the sound generating device being configured to vibrate the display panel to generate sound, wherein the sound generating device includes a first structure and a second structure on or under the first structure, the second structure including a first part having a piezoelectric characteristic and a second part between adjacent first parts to have flexibility.

For example, in a display apparatus according to an embodiment of the present disclosure, the first structure may include a polymer matrix and a piezoelectric material in the polymer matrix.

For example, in a display apparatus according to an embodiment of the present disclosure, the first part may include an inorganic material part, and the second part may include an organic material part.

For example, in a display apparatus according to an embodiment of the present disclosure, a size of the first part may differ from a size of the second part.

For example, in a display apparatus according to an embodiment of the present disclosure, a size of the first part may be the same as a size of the second part.

For example, in a display apparatus according to an embodiment of the present disclosure, a polarization direction of the first structure may be opposite to a polarization direction of the second structure.

For example, in a display apparatus according to an embodiment of the present disclosure, a polarization direction of the first structure and a polarization direction of the second structure are a direction vertical to the display panel.

For example, in a display apparatus according to an embodiment of the present disclosure, the display panel includes a display area configured to display an image and a non-display area surrounding the display area, and a size of the sound generating device may be 0.9 to 1.1 times a size of the display area.

For example, a display apparatus according to an embodiment of the present disclosure may further comprise a third structure over or under the first structure or over or under the second structure, the third structure being the same as the first structure or the second structure.

For example, in a display apparatus according to an embodiment of the present disclosure, the first structure may be disposed more adjacent to the display panel than the second structure, and the display apparatus may further comprise a third structure over the first structure, the third structure being the same as the second structure.

For example, in a display apparatus according to an embodiment of the present disclosure, a polarization direction of the first structure may be opposite to a polarization direction of the second structure and a polarization direction of the third structure.

For example, in a display apparatus according to an embodiment of the present disclosure, the second structure may be disposed more adjacent to the display panel than the first structure, the display apparatus may further comprise a third structure over the second structure, the third structure being the same as the first structure.

For example, in a display apparatus according to an embodiment of the present disclosure, a polarization direction of the second structure may be opposite to a polarization direction of the first structure and a polarization direction of the third structure.

For example, in a display apparatus according to an embodiment of the present disclosure, the display panel may have a certain curvature radius, and the sound generating device may be bent based on a curvature of the display panel.

For example, in a display apparatus according to an embodiment of the present disclosure, the display panel may include a display area configured to display an image and a non-display area surrounding the display area, and the non-display area may include a bending area, and the sound generating device may be at the display area and the bending area and may include a curve surface bent corresponding to the bending area.

For example, in a display apparatus according to an embodiment of the present disclosure, the display panel may be capable of being wound or unwound, and the sound generating device may be wound or unwound based on winding or unwinding of the display panel.

For example, in a display apparatus according to an embodiment of the present disclosure, a young's modulus of the first structure may be 1 GPa or less.

According to an embodiment of the present disclosure, a display apparatus includes a display panel configured to display an image and a sound generating device on a rear surface of the display panel, the sound generating device being configured to vibrate the display panel to generate sound, wherein the sound generating device includes a first structure including a polymer piezoelectric material, and a second structure over or under the first structure to have a piezoelectric characteristic.

For example, in a display apparatus according to an embodiment of the present disclosure, the polymer piezoelectric material may include a polymer matrix and a piezoelectric material in the polymer matrix.

For example, in a display apparatus according to an embodiment of the present disclosure, the second structure may include an inorganic material part and an organic material part between adjacent inorganic material parts.

For example, in a display apparatus according to an embodiment of the present disclosure, the second structure may be disposed more adjacent to the display panel than the first structure, the display apparatus may further include a third structure over the second structure and adjacent to the display panel, and the third structure may be the same as the first structure.

For example, in a display apparatus according to an embodiment of the present disclosure, a polarization direction of the second structure may be opposite to a polarization direction of the first structure and a polarization direction of the third structure.

For example, in a display apparatus according to an embodiment of the present disclosure, the display panel may include a display area configured to display the image and a non-display area surrounding the display area, the non-display area may include a bending area, and the sound generating device may be at the display area and the bending area and may include a curve surface bent along the bending area.

For example, in a display apparatus according to an embodiment of the present disclosure, the display panel may be capable of being wound or unwound, and the sound generating device may be wound or unwound based on winding or unwinding of the display panel.

For example, in a display apparatus according to an embodiment of the present disclosure, the display panel may have a certain curvature radius, and the sound generating device may be bent based on a curvature of the display panel.

According to an embodiment of the present disclosure, a sound generating device includes a first structure including a polymer piezoelectric material, and a second structure over or under the first structure, the second structure including a first part having a piezoelectric characteristic and a second part between adjacent first parts to have flexibility.

For example, in a sound generating device according to an embodiment of the present disclosure, the first structure may include a polymer matrix and a piezoelectric material in a polymer matrix.

For example, in a sound generating device according to an embodiment of the present disclosure, the first part may include an inorganic material part, and the second part comprises an organic material part.

For example, in a sound generating device according to an embodiment of the present disclosure, a polarization direction of the first structure may be opposite to a polarization direction of the second structure.

For example, a sound generating device according to an embodiment of the present disclosure may further include a third structure over or under the first structure or over or under the second structure, the third structure being the same as the first structure or the second structure.

It will be apparent to those skilled in the art that various modifications and variations may be made in the display apparatus of the present disclosure without departing from the technical idea or scope of the disclosures. Thus, it is intended that embodiments of the present disclosure cover the modifications and variations of the disclosure provided they come within the scope of the appended claims and their equivalents.

What is claimed is:

1. A display apparatus, comprising:
a display panel configured to display an image; and
a sound generating device on a rear surface of the display panel, the sound generating device being configured to vibrate the display panel to generate sound, the sound generating device comprising:
a first electrode;
a first structure under the first electrode, the first structure comprising a polymer matrix and a piezoelectric material dispersed in the polymer matrix;
a second electrode under the first structure; and
a second structure under the first structure, the second structure comprising:
a first part having a piezoelectric characteristic;
a second part between adjacent first parts to have flexibility; and
a third electrode under the second structure,
wherein the first part and the second part are alternatively disposed along a horizontal direction,
wherein a polarization direction of the first structure is different from a polarization direction of the second structure,
wherein an upper surface of the second structure is in contact with a lower surface of the second electrode, and
wherein a lower surface of the first structure is in contact with an upper surface of the second electrode.

2. The display apparatus of claim 1, wherein:
the first part comprises an inorganic material part; and
the second part comprises an organic material part.

3. The display apparatus of claim 1, wherein a size of the first part differs from a size of the second part.

4. The display apparatus of claim 1, wherein a size of the first part is the same as a size of the second part.

5. The display apparatus of claim 1, wherein a polarization direction of the first structure is opposite to a polarization direction of the second structure.

6. The display apparatus of claim 1, wherein a polarization direction of the first structure and a polarization direction of the second structure are a direction vertical to the display panel.

7. The display apparatus of claim 1, wherein:
the display panel comprises:
a display area configured to display an image; and
a non-display area surrounding the display area; and
a size of the sound generating device is 0.9 to 1.1 times a size of the display area.

8. The display apparatus of claim 1, further comprising a third structure over or under the first structure or over or under the second structure, the third structure being the same as the first structure or the second structure.

9. The display apparatus of claim 1, wherein:
the first structure is disposed more adjacent to the display panel than the second structure; and
the display apparatus further comprises a third structure over the first structure, the third structure being the same as the second structure.

10. The display apparatus of claim 9, wherein a polarization direction of the first structure is opposite to a polarization direction of the second structure and a polarization direction of the third structure.

11. The display apparatus of claim 1, wherein:
the second structure is disposed more adjacent to the display panel than the first structure; and
the display apparatus further comprises a third structure over the second structure, the third structure being the same as the first structure.

12. The display apparatus of claim 11, wherein a polarization direction of the second structure is opposite to a polarization direction of the first structure and a polarization direction of the third structure.

13. The display apparatus of claim 1, wherein:
the display panel has a certain curvature radius; and
the sound generating device is bent based on a curvature of the display panel.

14. The display apparatus of claim 1, wherein:
the display panel comprises:
a display area configured to display an image; and
a non-display area surrounding the display area;
the non-display area comprises a bending area;
the sound generating device is at the display area and the bending area; and
the sound generating device comprises a curved surface corresponding to the bending area.

15. The display apparatus of claim 1, wherein:
the display panel is capable of being wound or unwound; and
the sound generating device is wound or unwound based on winding or unwinding of the display panel.

16. The display apparatus of claim 1, wherein a Young's modulus of the first structure is 1 GPa or less.

17. The display apparatus of claim 1, wherein:
a polarization direction of the first structure is toward the second structure; and
a polarization direction of the second structure is toward the first structure.

18. A display apparatus, comprising:
a display panel configured to display an image; and
a sound generating device on a rear surface of the display panel, the sound generating device being configured to vibrate the display panel to generate sound, the sound generating device comprising:
a first electrode;
a first structure under the first electrode, the first structure comprising a polymer piezoelectric material comprising:
a polymer matrix; and
a piezoelectric material dispersed in the polymer matrix; and
a second electrode under the first structure;
a second structure under the first structure to have a piezoelectric characteristic, the second structure comprising an inorganic material part and an organic material part between adjacent inorganic material parts; and
a third electrode under the second structure,
wherein the inorganic material part and the organic material part are alternatively disposed along a horizontal direction,
wherein a polarization direction of the first structure is different from a polarization direction of the second structure,
wherein an upper surface of the second structure is in contact with a lower surface of the second electrode, and
wherein a lower surface of the first structure is in contact with an upper surface of the second electrode.

19. The display apparatus of claim 18, wherein:
the second structure is disposed more adjacent to the display panel than the first structure;

the display apparatus further comprises a third structure over the second structure and adjacent to the display panel; and the third structure is the same as the first structure.

20. The display apparatus of claim 19, wherein a polarization direction of the second structure is opposite to a polarization direction of the first structure and a polarization direction of the third structure.

21. The display apparatus of claim 18, wherein:

the display panel comprises:

a display area configured to display the image; and a non-display area surrounding the display area;

the non-display area comprises a bending area;

the sound generating device is at the display area and the bending area; and the sound generating device comprises a curved surface along the bending area.

22. The display apparatus of claim 18, wherein:

the display panel is capable of being wound or unwound; and the sound generating device is wound or unwound based on winding or unwinding of the display panel.

23. The display apparatus of claim 18, wherein:

the display panel has a certain curvature radius; and the sound generating device is bent based on a curvature of the display panel.

24. The display apparatus of claim 18, wherein a polarization direction of the first structure is opposite to a polarization direction of the second structure.

25. The display apparatus of claim 18, wherein a polarization direction of the first structure and a polarization direction of the second structure are in a direction vertical to the display panel.

26. The display apparatus of claim 18, wherein:

a polarization direction of the first structure is toward the second structure; and a polarization direction of the second structure is toward the first structure.

* * * * *